US007884340B2

(12) United States Patent
Nutt

(10) Patent No.: US 7,884,340 B2
(45) Date of Patent: Feb. 8, 2011

(54) LOW-VOLUME BIOMARKER GENERATOR

(75) Inventor: Ronald Nutt, Knoxville, TN (US)

(73) Assignee: Advanced Biomarker Technologies, LLC, Knoxville, TN (US)

( * ) Notice: Subject to any disclaimer, the term of this patent is extended or adjusted under 35 U.S.C. 154(b) by 230 days.

(21) Appl. No.: 12/333,300

(22) Filed: Dec. 11, 2008

(65) Prior Publication Data

US 2009/0218520 A1 Sep. 3, 2009

Related U.S. Application Data

(63) Continuation-in-part of application No. 11/441,999, filed on May 26, 2006, now Pat. No. 7,476,883, and a continuation-in-part of application No. 11/736,032, filed on Apr. 17, 2007, now Pat. No. 7,466,085.

(51) Int. Cl.
*G21G 1/10* (2006.01)

(52) U.S. Cl. ..... 250/493.1

(58) Field of Classification Search ..... 250/493.1, 250/496.1, 308; 376/157, 171
See application file for complete search history.

(56) References Cited

U.S. PATENT DOCUMENTS

| | | | |
|---|---|---|---|
| 1,948,384 | A | 2/1934 | Lawrence |
| 3,432,657 | A | 3/1969 | Slavin |
| 3,576,997 | A | 5/1971 | Slavin |
| 4,206,383 | A | 6/1980 | Anicich et al. |
| 4,457,972 | A | 7/1984 | Griffith et al. |
| 4,639,348 | A | 1/1987 | Jarnagin |
| 5,037,602 | A | 8/1991 | Dabiri et al. |
| 5,160,696 | A | 11/1992 | Bowman |
| 5,463,291 | A | 10/1995 | Carroll et al. |
| 5,468,355 | A | 11/1995 | Shefer et al. |
| 5,471,061 | A | 11/1995 | Moyers et al. |
| 5,586,153 | A | 12/1996 | Alvord |
| 5,750,991 | A | 5/1998 | Moyers et al. |
| 5,808,146 | A | 9/1998 | Goodman et al. |
| 5,818,170 | A | 10/1998 | Kikunaga et al. |
| 5,847,401 | A | 12/1998 | McKeown et al. |
| 5,870,447 | A | 2/1999 | Powell et al. |
| 5,879,661 | A | 3/1999 | Conti et al. |
| 5,886,142 | A | 3/1999 | Thakur et al. |
| 5,898,178 | A | 4/1999 | Bunker |
| 5,917,874 | A | 6/1999 | Schlyer et al. |
| 6,060,833 | A | 5/2000 | Velazco |
| 6,163,006 | A | 12/2000 | Doughty et al. |
| 6,239,541 | B1 | 5/2001 | Fujisawa |
| 6,396,024 | B1 | 5/2002 | Doughty et al. |
| 6,442,226 | B1 | 8/2002 | Venneri et al. |
| 6,523,338 | B1 | 2/2003 | Kornfeld et al. |
| 6,683,319 | B1 | 1/2004 | Koenck et al. |
| 6,683,426 | B1 | 1/2004 | Kleeven |
| 6,838,676 | B1 | 1/2005 | Jackson |

(Continued)

*Primary Examiner*—Kiet T Nguyen
(74) *Attorney, Agent, or Firm*—Pitts & Brittian PC

(57) ABSTRACT

A low-volume biomarker generator for producing ultra-short lived radiopharmaceuticals. The low-volume biomarker generator system includes a low-power cyclotron and a radiochemical synthesis system. The cyclotron of the low-volume biomarker generator is optimized for producing radioisotopes useful in synthesizing radiopharmaceuticals in small quantities down to approximately one (1) unit dose. The cyclotron incorporates permanent magnets in place of electromagnets and/or an improved rf system to reduce the size, power requirements, and weight of the cyclotron. The radiochemical synthesis system of the low-volume biomarker is a small volume system optimized for synthesizing the radiopharmaceutical in small quantities of approximately one (1) unit dose.

7 Claims, 11 Drawing Sheets

U.S. PATENT DOCUMENTS

| | | | |
|---|---|---|---|
| 7,466,085 | B2 | 12/2008 | Nutt |
| 7,476,883 | B2 | 1/2009 | Nutt |
| 2004/0046116 | A1 | 3/2004 | Schroeder et al. |
| 2004/0258615 | A1 | 12/2004 | Buchanan et al. |
| 2005/0232387 | A1 | 10/2005 | Padgett et al. |
| 2005/0232861 | A1 | 10/2005 | Buchanan et al. |
| 2005/0269497 | A1 | 12/2005 | Jongen |
| 2006/0049902 | A1 | 3/2006 | Kaufman |
| 2007/0273308 | A1 | 11/2007 | Fritzler et al. |
| 2010/0127188 | A1 * | 5/2010 | Nutt ..... 250/491.1 |

* cited by examiner

METHOD FOR GENERATING A UNIT DOSE OF BIOMARKER

LOW-VOLUME BIOMARKER GENERATOR

CROSS-REFERENCE TO RELATED APPLICATIONS

This application is a continuation-in-part of U.S. application Ser. No. 11/441,999, filed May 26, 2006 and a continuation-in-part of U.S. application Ser. No. 11/736,032, filed Apr. 17, 2007, now U.S. Pat. No. 7,466,085.

STATEMENT REGARDING FEDERALLY-SPONSORED RESEARCH OR DEVELOPMENT

Not Applicable

BACKGROUND OF THE INVENTION

1. Field of Invention

This invention relates to a low-volume biomarker generator used in radiopharmaceutical production.

2. Description of the Related Art

Cyclotrons are used to generate high energy charged particle beams for purposes such as nuclear physics research and medical treatments. One area where cyclotrons have found particular utility is in the generation of biomarkers for medical diagnosis by such techniques as positron emission tomography (PET). A conventional cyclotron involves a substantial investment, both in monetary and building resources. In addition to a large size and weight, the power requirements often involve a dedicated and substantial electrical power system due to the high voltage supply necessary for the radio frequency system to accelerate the particles into a beam sufficient to overcome the binding energy (nominally 7-9 MeV) causing a stable target isotope to become a radioisotope. Thus, medical facilities have a need for biomarkers, but the monetary, structural, and power requirements of conventional cyclotrons have historically made it impracticable for most hospitals and other medical facilities to produce biomarkers on-site.

The half-life of clinically important positron-emitting isotopes, i.e., radionuclides, relative to the time required to process a radiochemical is a significant factor in biomarker generation. The large linear dimensions of the reaction vessel in radiochemical synthesis systems commonly used in biomarker generators result in a small ratio of surface area-to-volume and effectively limit the heat transfer and mass transport rates and lengthens processing time. The four primary PET radionuclides, fluorine-18, oxygen-15, nitrogen-13, and carbon-11, are considered to have short half-lives. For example, fluorine-18 has a half-life of approximately 110 minutes. Converting nucleophilic fluorine-18 ([$^{18}$F]F) into the biomarker [$^{18}$F]fluorodeoxyglucose ([$^{18}$F]FDG) requires approximately 45 minutes using one of the larger conventional radiochemical synthesis systems. The processing time is significant with, respect to the half-life of the radioisotope, with a processing time-to-half-life ratio of approximately 40%. Because some of the radioisotope will decay during processing, the percent yield of the biomarker is reduced, in this case, to a range of approximately 50 to 60%. Even with efficient distribution networks, the short half-lives and low yields require production of a greater amount of the biomarker than is actually needed for the intended use.

Recent advancements have led to the development of smaller reaction systems. By reducing the linear dimensions of the reaction vessel used in the radiochemical synthesis system, the ratio of surface area-to-volume and, consequently, heat transfer and mass transport rates increases. The smaller size of the reaction vessels lends itself to replication allowing multiple reaction vessels to be placed in parallel to simultaneously process the biomarker. In addition to faster processing times and reduced space requirements, these smaller reaction systems require less energy. However, such advancement has not been seen with the cyclotrons necessary for radioisotope production.

A biomarker is used to interrogate a biological system and can be created by "tagging" or labeling certain molecules, including biomolecules, with a radioisotope. A biomarker that includes a positron-emitting radioisotope is required for positron emission tomography (PET), a noninvasive diagnostic imaging procedure that is used to assess perfusion or metabolic, biochemical and functional activity in various organ systems of the human body. Because PET is a very sensitive biochemical imaging technology and the early precursors of disease are primarily biochemical in nature, PET can detect many diseases before anatomical changes take place and often before medical symptoms become apparent. PET is similar to other nuclear medicine technologies in which a radiopharmaceutical is injected into a patient to assess metabolic activity in one or more regions of the body. However, PET provides information not available from traditional imaging technologies, such as magnetic resonance imaging (MRI), computed tomography (CT), and ultrasonography, which image the patient's anatomy rather than physiological images. Physiological activity provides a much earlier detection measure for certain forms of disease, cancer in particular, than do anatomical changes over time.

A positron-emitting radioisotope undergoes radioactive decay, whereby its nucleus emits positrons. In human tissue, a positron inevitably travels less than a few millimeters before interacting with an electron, converting the total mass of the positron and the electron into two photons of energy. The photons are displaced at approximately 180 degrees from each other, and can be detected simultaneously as "coincident" photons on opposite sides of the human body. The modern PET scanner detects one or both photons, and computer reconstruction of acquired data permits a visual depiction of the distribution of the isotope, and therefore the tagged molecule, within the organ being imaged.

In the field of nuclear medicine, it is well known that cyclotrons are used for producing radiopharmaceuticals for use in imaging. Most clinically important positron emitting radioisotopes are produced in a cyclotron. Cyclotrons, including two-pole, four-pole, and eight-pole cyclotrons, operate by accelerating electrically-charged particles along outward, quasi-spherical orbits to a predetermined extraction energy generally on the order of millions of electron volts. The high-energy electrically-charged particles form a continuous beam that travels along a predetermined path and bombards a target. When the bombarding particles interact in the target, a nuclear reaction occurs at a sub-atomic level, resulting in the production of a radioisotope.

Conventional cyclotrons employ a concept called "sector focusing" to constrain the vertical dimension of the accelerated particle beam within the poles of the cyclotron magnet. The magnet poles contain at least two wedge-shaped sectors, commonly known as "hills", where the magnetic flux is mostly concentrated. The hills are separated by regions, commonly referred to as "valleys", where the magnet gap is wider. As a consequence of the wider gap the flux density, or field strength, in the valleys is reduced compared to that in the hills.

An exemplary conventional two-pole cyclotron is illustrated in FIG. 1. A conventional two-pole cyclotron has an RF system that includes a plurality of semi-circular or wedge-shaped, hollow electrodes 12*a*, 12*b*. The hollow electrodes 12*a*, 12*b*, commonly referred to as "dees" because of their shape, each define a curved side 16*a*, 16*b*. The dees 12*a*, 12*b* are coplanar and are positioned relative to one another such that their respective curved sides 16*a*, 16*b* are concentric to define a diameter 20. Each of the dees 12*a*, 12*b* defines an entrance 22 to allow access to the interior of the dee and an exit 24. The energy for accelerating the beam 40 of electrically-charged particles is provided by an externally-supplied alternating high voltage. The dees 12*a*, 12*b* generally are composed of low-resistance copper so that relatively high traveling currents do not cause uneven voltage distribution within the dee structure.

A cyclotron uses a magnetic field to direct beams of charged particles along a predetermined path. As illustrated in FIG. 1, the two-pole cyclotron includes a magnet system having four magnet poles, each defining a wedge shape. The upper magnet poles 26, 28 protrude downward from the upper magnet yoke 54, toward the lower magnet poles 30, 32 which protrude upward from the lower magnet yoke 56. The magnetic field, which is represented by the arrows 58, is perpendicular to the longitudinal plane of the dees and, therefore, is perpendicular also to the electric field generated by the alternating high voltage. The magnetic field exerts a force that is perpendicular both to the direction of motion of the charged particle and to the magnetic field. Hence, a charged particle in a magnetic field having a constant strength undergoes circular motion if the area defined by the magnetic field is sufficiently large. The diameter of the circular path of the charged particle is dependent on the velocity of the charged particle and on the strength of the magnetic field. It is prudent to note that a magnetic field causes a charged particle to change direction continuously; however, it does not alter the velocity of a charged particle, hence the energy of the charged particle is unaffected.

The cyclotron of FIG. 1 illustrates the general magnetic system. In the limiting case of the "separated sector cyclotron" each hill sector is a complete, separate, stand-alone magnet with its own gap, poles, return/support yoke, and common excitation coil. In this implementation the valleys are merely large void spaces containing no magnet steel. Essentially all the magnetic flux is concentrated in the hills and almost none is in the valleys. In addition to providing tight vertical focusing, the separated-sector configuration allows convenient placement of accelerating electrodes and other apparatus in the large void spaces comprising the valleys.

Vertical focusing of the beam is enhanced by a large ratio of hill field to valley field; the higher the ratio, the stronger are the forces tending to confine the beam close to the median plane. In principle, a tighter confinement, in turn, reduces the required magnet gap without danger of the beam striking the pole faces in the magnet. For a given amount of flux in the gap, a magnet with a small gap requires less electrical power for excitation than does a magnet with a large gap.

Some conventional cyclotrons use electromagnets in the magnetic system. More recently, superconducting magnet technology has been applied to cyclotrons. In superconducting cyclotron designs, the valleys are also large void spaces in which accelerating electrodes and other apparatus may be conveniently emplaced. The magnet excitation for a superconducting cyclotron is usually provided by a single pair of superconducting magnet coils which encircle the hills and valleys. A common return/support yoke surrounds the excitation coil and magnet poles.

FIG. 2 is a representative illustration of a conventional cyclotron focusing on the dees. For simplicity, only two dees 12*a*, 12*b* are illustrated. However, there are typically four or more dees used. As will be discussed below, ions are accelerated in a substantially circular, outwardly spiraling path. In devices using fewer dees, either more turns are required, or a higher acceleration voltage is required, or both, in order to energize the ions to the desired level. As The dees 12*a*, 12*b* are positioned in the valley of the large electromagnet. Near the center of the dees 12*a*, 12*b* is the ion source 81 used for generating charged particles. The ion source 81 is typically an electrical arc device 50 in a gas.

During operation, ions are continuously generated by the ion source 81. A filament located in the ion source assembly creates both negative and positive ions through the addition of electrons or the subtraction of electrons. As the negative ions enter the vacuum tank (not shown) enclosing the dees 12*a*, 12*b*, they gain energy due to a high-frequency alternating electric field induced on the dees 12*a*, 12*b*. As the negative ions flow from the ion source 81, they are exposed to this electric field as well as a strong magnetic field generated by two magnet poles, one above and one below the vacuum tank. Because these are charged particles in a magnetic field, the negative ions move in a circular path.

When the negative ions reach the edges of the dees 12*a*, 12*b* and enter the gap, the RF oscillator changes the polarities on the dees 12*a*, 12*b*. The negative ions are repelled as they exit the previously positive but now negatively charged dee 12*a*, 12*b*. Each time the particles cross the gap they gain energy, so the orbital radius continuously increases and the particles follow an outwardly spiraling path. The particles are pushed from the first dee 12*a* and drift along a circular path until they are attracted or pulled by the second dee 12*b* which has become positively charged. The result is a stream of negative ions which are accelerated in a circular path spiraling outward.

Returning to FIG. 1, all four of the hills 26, 28, 30, 32 and two of the four valleys 34, 36 are visible. The beam 40, during acceleration, is exposed alternately to the strong and weak magnetic fields defined respectively by the hills and valleys along its path to the extraction radius. As the beam 40 passes through each hill region, it bends sharply due to the effect of the strong magnetic field. While in the valley regions, however, the beam trajectory is more nearly a straight path toward the next hill region. This alternating magnetic field provides strong vertical focusing forces to beam particles straying from the median plane during acceleration. These focusing forces direct straying particles back toward the median plane, promoting high beam extraction efficiencies.

As indicated previously, the RF system of a cyclotron supplies an alternating high voltage potential to the dees. In the cyclotron depicted in FIG. 1, each of the two dees 12*a*, 12*b* is mounted in a valley region. The beam 40 of positively-charged particles gains energy by being attracted by the dee when the dee has a negative charge, and then by being repelled from the dee as the dee changes to a positive charge. Thus, because a charged particle within the beam 40 passes through both dees 12*a*, 12*b* in the course of a single orbit, that charged particle undergoes two increments of acceleration per orbit. Therefore, with every acceleration, the beam 40 of charged particles gains a known, fixed quantity of energy, and its orbital radius increases in predetermined fixed increments until it reaches the extraction radius, which corresponds to the extraction energy of the beam.

The combined effects of the RF system and the magnet system on a charged particle are clarified in the following example: In a positive-ion two-pole cyclotron, such as that depicted in FIG. 1, positively-charged particles in the first dee, which is mounted in the first valley, are accelerated by a negative electric field generated within the first dee. Once these particles exit the first dee and enter the first hill, the magnetic field directs them toward the second dee, which is mounted in the second valley. Upon entering the second dee, the positively-charged particles are accelerated by a negative electric field generated within that dee. Once these particles exit the second dee and enter the second hill, the magnetic field directs them back into the first dee. By repeating this method, the cyclotron predictably and incrementally accelerates the charged particles along a predetermined path, by the end of which the charged particles have acquired their predetermined extraction energy.

As the velocity of a charged particle increases, an ever-strengthening magnetic field is required to maintain the charged particle on the same circular path. Consequently, in a cyclotron, which generates a magnetic field having a constant strength, the incremental acceleration of a charged particle causes the particle to follow an outward, quasi-spiral orbit 70. Thus, the magnetic field is the "bending" force that directs the beam 40 of charged particles along an outward, quasi-spiral orbit 70 around a point centrally located between the dees 12*a*, 12*b*.

Having reviewed the essential principles concerning the functioning of a cyclotron, it is helpful to summarize more of the systems that are included in a cyclotron, all of which are well known in the prior art. The following systems are summarized briefly below: (1) the ion source system, (2) the target system, (3) the shielding system and (4) the radioisotope processing system (optional). Thereafter, the two systems addressed previously in the context of a two-pole cyclotron, i.e., the magnet system and the RF system, are addressed in the context of a four-pole cyclotron.

The ion source system 80 is required for generating the charged particles for acceleration. Although several ion source systems are well known in the prior art, in the interest of brevity, only one of these systems is summarized below. Those skilled in the art will acknowledge that an ion source system comprising an internally, axially-mounted Penning Ion Gauge (PIG) ion source optimized for proton ($H^+$) production is useful for producing fluorine-18, among other positron-emitting radioisotopes. This ion source system ionizes hydrogen gas using a strong electric current. The ionized hydrogen gas forms plasma, from which protons ($H^+$ ions) are extracted for acceleration using a bias voltage.

After the beam 40 of charged particles acquires its extraction energy, it is directed into the target system 88. Target systems are well known in the prior art. In general, the beam exits the magnetic field 58 at the predetermined location 90 and enters the accelerator beam tube 92, which is aligned with the target entrance 94. A collimater 96, which consists of a carbon disk defining a central hole, is mounted at the target entrance 94, and as the beam 40 passes through the collimater 96, the collimater 96 refines the profile of the beam. The beam 40 then passes through the target window 98, which consists of an extremely thin sheet of foil made of a high-strength, non-magnetic material such as titanium. Thereafter, the beam 40 encounters the target substance 100, which is positioned behind the target window 98. The beam 40 bombards the target substance 100, which may comprise a gas, liquid, or solid, generating the desired radioisotope through a nuclear reaction.

Cyclotrons vary in the method used to extract the beam such that it exits the magnetic field at the predetermined location. Regarding a negative-ion cyclotron (not shown), the beam, which initially consists of negatively-charged particles, is extracted by changing its polarity. A thin sheet of carbon foil is positioned in the path of the beam, specifically, along the extraction radius. As the beam interacts with the carbon foil, the negatively-charged particles lose their electrons and, accordingly, become positively charged. As a result of this change in polarity, the magnetic field forces the beam, now consisting of positively-charged particles, in the opposite direction instead, causing the beam to exit at the predetermined location and enter the accelerator beam tube. It is important to note that the carbon foil acquires only a trivial amount of radioactivity as a result of its interaction with the beam. Regarding a positive-ion cyclotron, however, carbon foil cannot be used to change the polarity of the beam because the beam initially consists of positively-charged particles, which already have an electron deficit. Instead, as depicted in FIG. 1, a conventional positive-ion cyclotron uses a magnet extraction mechanism that includes two blocks 102, 104 made of a metal such as nickel. The first block 102 is affixed to an upper magnet pole such that it protrudes downward toward a lower magnet pole. The second block 104 is affixed, opposite the first block, to a lower magnet pole such that it protrudes upward toward an upper magnet pole. The blocks 102, 104 are positioned above and below the extraction radius, respectively, and they operate to perturb the magnetic field such that its effect on the beam, as it passes between the blocks 102, 104, is mitigated at that location. Hence, the "bending" force exerted by the magnetic field on the beam at that location is weakened, causing the beam to exit at the predetermined location and enter the accelerator beam tube. Inevitably, the edges of the beam interact with the two blocks 102, 104, converting them, at least in part, into a metal radioisotope that has a long half-life. Due to this long half-life, the metal radioisotope accumulates in the blocks 102, 104 during operation, rapidly becoming a significant, enduring, and worrisome source of harmful radiation. In sum, in comparison to a negative-ion cyclotron, a conventional positive-ion cyclotron is disadvantaged in that its magnet extraction mechanism is a major source of harmful radiation.

Harmful radiation is generated as a result of operating a cyclotron, including a negative-ion cyclotron, and it is attenuated to acceptable levels by a shielding system, several variants of which are well known in the prior art. A cyclotron has several sources of radiation that warrant review. First, prompt high-energy gamma radiation and neutron radiation, a byproduct of nuclear reactions that produce radioisotopes, are emitted when the beam, or a particle thereof, is deflected during acceleration by an extraction mechanism into an interior surface of the cyclotron. As stated previously, such deflections are a major source of harmful radiation in a conventional positive-ion cyclotron. In the target system 88, prompt high-energy gamma radiation and neutron radiation are generated by the nuclear reaction that occurs as the beam 40 bombards the target substance 100, producing the desired radioisotope. Also in the target system 88, induced high-energy gamma radiation is generated by the direct bombardment of target system components such as the collimater 96 and the target window 98. Finally, residual radiation is indirectly generated by the nuclear reaction that yields the radioisotope. During the nuclear reaction, neutrons are ejected from the target substance 100, and when they strike an interior surface of the cyclotron, gamma radiation is generated. Although commonly composed of layers of exotic and costly materials, shielding systems only can attenuate radiation; they cannot absorb all of the gamma radiation or other ionizing radiation.

Following the generation of the desired radioisotope, the target substance 100 commonly is transferred to a radioisotope processing system. Such radioisotope processing systems are numerous and varied and are well known in the prior art. A radioisotope processing system processes the radioisotope primarily for the purpose of preparing the radioisotope for the tagging or labeling of molecules of interest, thereby enhancing the efficiency and yield of downstream chemical processes. For example, undesirable molecules, such as excess water or metals, are extracted.

FIG. 3 depicts some of the components of the magnet system 120 and the RF system 150 typical of a positive-ion four-pole cyclotron. The magnet system 120 comprises eight magnet poles, each defining a wedge shape. Four of the magnet poles extend from the upper magnet yoke downward, toward the remaining four magnet poles, which extend upward from the lower magnet yoke. As stated previously, magnet poles are often called "hills," and the hills define recesses that are often called "valleys." In FIG. 3, only seven of the hills 122, 124, 126, 128, 130, 132, 133 and six of the valley regions 134, 136, 138, 120, 122, 124 are at least partially depicted. The beam 40, during acceleration, is exposed alternately to the strong and weak magnetic fields defined respectively by the hills and valleys along its path to the extraction radius. The RF system 150 of a four-pole cyclotron includes four dees 152, 154, 156, 158, each having a wedge shape. Each of the four dees 152, 154, 156, 158 is mounted in a valley region 134, 136, 138, 120. The beam 40 of charged particles gains energy by being attracted to, and then repelled from, each dee through which it passes. Thus, because a charged particle within the beam 40 passes through all four dees 152, 154, 156, 158 in the course of a single orbit, that charged particle, which experiences an increment of acceleration per dee, undergoes four increments of acceleration per orbit.

Cyclotrons that are typical of the art are those devices disclosed in the following U.S. Pat. Nos.:

| Patent No. | Inventor(s) | Issue Date |
|---|---|---|
| 1,948,384 | E. O. Lawrence | Feb. 20, 1934 |
| 4,206,383 | V. G. Anicich et al. | Jun. 3, 1980 |
| 4,639,348 | W. S. Jarnagin | Jan. 27, 1987 |
| 5,463,291 | L. Carroll et al. | Oct. 31, 1995 |
| 5,818,170 | T. Kikunaga et al. | Oct. 6, 1998 |
| 6,060,833 | J. E. Velazco | May 9, 2000 |
| 6,163,006 | F. C. Doughty et al. | Dec. 19, 2000 |
| 6,396,024 | F. C. Doughty et al. | May 28, 2002 |
| 6,523,338 | G. Kornfeld et al. | Feb. 25, 2003 |
| 2004/0046116 | J. B. Schroeder et al. | Mar. 11, 2004 |
| 2006/0049902 | L. Kaufman | Mar. 9, 2006 |

Of these patents, Lawrence, in his '384 patent, discloses a method and apparatus for the acceleration of ions. The Lawrence patent is based primarily upon the cumulative action of a succession of accelerating impulses, each requiring only a moderate voltage, but eventually resulting in an ion speed corresponding to a much higher voltage. According to Lawrence, this is accomplished by causing ions or electrically charged particles to pass repeatedly through accelerating electric fields in such a manner that the motion of the ion or charged particle is in resonance or synchronism with oscillations in the electric accelerating field or fields.

Anicich et al., in their '383 patent, disclose a miniaturized ion source device in an air gap of a small permanent magnet with a substantially uniform field in the air gap of about 0.5 inch. The device and permanent magnet are placed in an enclosure which is maintained at a high vacuum (typically $10^{-7}$ torr) into which a sample gas can be introduced. The ion-beam end of the device is placed very close to an aperture through which an ion beam can exit into apparatus for an experiment.

Jarnagin, in his '348 patent, discloses a re-circulating plasma fusion system. The '348 patent claims to include a plurality of recyclotrons, each comprising cyclotron means for receiving and accelerating charged particles in spiral and work conservative pathways, and output means for forming a beam from particles received. The cyclotron means used by Jarnagin includes a channel shaped electromagnet having a pair of indented polefaces oriented along an input axis and defining an input magnetic well. The cyclotron further includes a pair of elongated linear electrodes centered along the input magnetic well arranged generally parallel to the input axis and having a gap therebetween. A tuned oscillator means is connected to the electrodes for applying an oscillating electric potential thereto. The output means includes an inverter means including an electromagnet having a polarity opposite that of the channel shaped electromagnet oriented contigously therealong for extracting fully accelerated particles from the cyclotron means. A reinverter means includes an electromagnet having a polarity the same as that of the channel shaped electromagnet for correcting the flight path of the extracted particles, the inverter means and the reinverter means defining an output axis, along which the output means directs the beam. The recyclotrons are arranged so that particles of the output beam are received by the input magnetic well of an opposing similar recyclotron.

Carroll, et al., in their '291 patent, disclose a cyclotron and associated magnet coil and coil fabricating process. The cyclotron includes a return yoke defining a cavity therein. A plurality of wedge-shaped regions called "hills" are disposed in the return yoke, and voids called "valleys" are defined between the hills. A single, substantially circular magnet coil surrounds and axially spans the hills and the valleys.

In the '170 patent, Kikunaga et al., disclose a gyrotron system including an electron gun that produces an electron beam. A magnetic field generating unit comprises a permanent magnet and two electromagnets, and is capable of generating an axial magnetic field that drives electrons emitted from the electron gun for revolving motion. A cavity resonator causes cyclotron resonance maser interaction between the revolving electrons and a high-frequency electromagnetic field resonating in a natural mode. A collector collects the electron beam that has traveled through the cavity resonator. An output window is provided, through which a high-frequency wave produced by the cyclotron resonance maser interaction propagates.

Velazco, in the '833 patent, discloses an electron beam accelerator utilizing a single microwave resonator holding a transverse-magnetic circularly polarized electromagnetic mode and a charged-particle beam immersed in an axial focusing magnetic field.

In their '006 patent, Doughty et al., disclose a plasma-producing device wherein an optimized magnet field for electron cyclotron resonance plasma generation is provided by a shaped pole piece.

In their '024 patent, Doughty et al., disclose a method and apparatus for integrating multipolar confinement with permanent magnetic electron cyclotron resonance plasma sources to produce highly uniform plasma processing for use in semiconductor fabrication and related fields. The plasma processing apparatus includes a vacuum chamber, a workpiece stage within the chamber, a permanent magnet electron cyclotron resonance plasma source directed at said chamber, and a system of permanent magnets for plasma confinement about the periphery of the chamber.

Kornfeld et al., in the '338 patent, disclose a plasma accelerator arrangement in particular for use as an ion thruster in a spacecraft. A structure is proposed in connection with which an accelerated electron beam is admitted into an ionization chamber with fuel gas, and is guided through the ionization chamber in the form of a focused beam against an electric deceleration field, said electric deceleration field acting at the same time as an acceleration field for the fuel ions produced by ionization.

In Published Application No. 2004/0046116, Schroeder et al., disclose a negative ion source placed inside a negatively-charged high voltage terminal for emitting a beam which is accelerated to moderate energy and filtered by a momentum analyzer to remove unwanted ions. Reference ions such as carbon-12a are deflected and measured in an off-axis Faraday cup. Ions of interest, such as carbon ions of mass 12b, are accelerated through 300 kV to ground potential and passed through a gas stripper where the ions undergo charge exchange and molecular destruction. The desired isotope, carbon-12b along with fragments of the interfering molecular ions, emerges from the stripper into a momentum analyzer which removes undesirable isotope ions. The ions are further filtered by passing through an electrostatic spherical analyzer to remove ions which have undergone charge exchange. The ions remaining after the spherical analyzer are transmitted to a detector and counted.

In Published Application No. 2006/0049902, Kaufman defines a plurality of permanent magnets to enhance radiation dose delivery of a high energy particle beam. The direction of the magnetic field from the permanent magnets may be changed by moving the permanent magnets.

A cyclotron (or other particle accelerator), although required for the production of positron radiopharmaceuticals, was (and still is) uncommon due to its high price, high cost of operation, and stringent infrastructure requirements relating to it immensity, weightiness and high energy consumption. Consequently, at one time, a great majority of institutions did not have a PET scanner. Thereafter, however, some businesses, e.g., CTI PETNet, established relatively efficient distribution networks to supply hospitals and imaging centers with positron radiopharmaceuticals, thereby allowing them to avoid the substantial costs and other impracticalities associated with cyclotrons. Consequently, the number of PET scanners in operation increased dramatically relative to the number of cyclotrons in operation. However, because the half-lives of positron radiopharmaceuticals are short, there still exists an inherent inefficiency in a radiopharmaceutical distribution network that cannot be overcome. This inefficiency results, in part, from the radioactive decay of the radiopharmaceutical during transport from the site of production to the hospital or imaging center. It results also, in part, from the limitations inherent in the conventional (macroscale) chemical apparatuses that receive the radioisotopes and use them in synthesizing radiopharmaceuticals. The processing times that such apparatuses require are lengthy relative to the half-lives of most clinically-important positron-emitting radioisotopes. For example, CTI's Explora $FDG_4$, an efficient macroscale chemical apparatus, requires forty-five (45) minutes to convert nucleophilic fluorine-18 ($[^{18}F]F^-$) into $[^{18}F]$ fluorodeoxyglucose ($[^{18}F]$FDG), a glucose analogue that is commonly used in PET. Fluorine-18 has a half-life of only 110 minutes. Also, to generate the relatively large quantities of $[^{18}F]F^-$ required of the Explora $FDG_4$, which is on the order of curies (Ci), the bombardment of the target material generally continues for approximately two (2) hours. During that time, however, a significant percentage of the newly generated $[^{18}F]F^-$ decays back to its original oxygen state. Also, the percent yield of the macroscale chemical apparatus is only approximately 50 to 60%. The limitations of macroscale chemical apparatuses are even more evident when preparing biomarkers that are labeled with positron-emitting radioisotopes having even shorter half-lives, such as carbon-11 ($t_{1/2}$=20 min), nitrogen-13 ($t_{1/2}$=10 min), and oxygen-15 ($t_{1/2}$=2 min).

In recent years, however, a promising new discipline, sometimes referred to as microreaction technology, has emerged. A microreactor is a miniaturized reaction system fabricated, at least in part, using methods of microtechnology and precision engineering. The first prototype microreactors for chemical processes, including chemical synthesis, were manufactured and tested in the early 1990's. The characteristic linear dimensions of the internal structures of a microreactor, such as fluid channels, generally are in the nanometer to millimeter range. For example, the fluid channels in a microreactor typically have a diameter of between approximately a few nanometers and approximately a few millimeters. The length of such channels, however, can vary significantly, i.e., from on the order of millimeters to on the order of meters, depending on the function of the channel. There are exceptions, however, and microreactors having characteristic linear dimensions that are shorter or longer have been developed. A microreactor may include only one functional component, and that component may be limited to a single operation, such as mixing, heat exchange, or separation. Examples of such functional components include micropumps, micromixers, and micro heat exchangers. As more than one operation generally is necessary to perform even the simplest chemical process, more complex systems, sometimes referred to as integrated microreaction systems, have been developed. Typically, such a system includes at least several different functional components, and the configuration of such systems can vary significantly depending on the chemical process that the system is engineered to perform. Additionally, integrated microreaction systems that include arrays of microreactors have been developed to provide continuous-flow production of chemicals.

In microreaction systems, an increase in throughput is achieved by increasing the number of microreactors (numbering up), rather than by increasing the dimensions of the microreactor (scaling up). Thus, additional microreactors are configured in parallel to achieve the desired increase in throughput. Numbering up is the preferred method because only it can preserve the advantages unique to a microreaction system, which are summarized below and are derived from the minuscule linear dimensions of the system's internal structures.

First, as the linear dimensions of a reactor decrease, the surface area to volume ratio of the reactor increases. Accordingly, the surface area to volume ratio of the internal structures of a microreactor generally range from 10,000 to 50,000 $m^2/m^3$, whereas typical laboratory and production vessels usually do not exceed 1000 $m^2/m^3$ and 100 $m^2/m^3$, respectively. Because of its high surface area to volume ratio, a microreactor has an exchange surface for heat transfer and mass transport that is relatively far greater than that of a conventional reactor. This promotes very rapid heating, cooling, and mixing of reagents, which can improve yields and decrease reaction times. This is especially significant because, when synthesizing fine chemicals (e.g., radiopharmaceuticals) using conventional systems, the reaction time usually is extended beyond what is kinetically necessary to compensate for the relatively slow heat transfer and mass transport typical of a system having a conventional surface area to volume ratio. When using a microreaction system, the reaction time does not need to be extended significantly to allow for effective heat transfer and mass transport. Consequently, chemical synthesis is significantly more rapid, and the percent yield of a microreaction system is significantly higher, especially in comparison to a conventional (macroscale) system using a batch-production process.

Second, it is critical to note that the behavior of a fluid, namely a liquid or a gas, in a milliscale, microscale, or nanoscale system differs significantly from the behavior of a fluid in a conventional (macroscale) system. In a system that is not at equilibrium regarding one or more physical properties (e.g., concentration, temperature, or pressure), the linear dimensions of the system are factors in determining the gradient relating to each physical property. As linear dimensions decrease, each gradient increases, thereby increasing the force driving the system toward equilibrium. For example, in the absence of mixing, molecules of a gas spontaneously undergo random movement, the result of which is the net transport of those molecules from a region of higher concentration to one of lower concentration, as described in Fick's laws of diffusion. More particularly, Fick's first law of diffusion states that the flux of the diffusing material in any part of the system is proportional to the local concentration gradient. Thus, in a system having linear dimensions on the order of nanometers, for example, the diffusional flux would very rapidly drive the system to constant concentration. To explain further using another method, the mobility of water can be expressed in terms of a diffusion coefficient, D, which for water equals approximately $2.4\times10^{-5}$ $cm^2/s$ at 25° C., where D is a proportionality constant that relates the flux of amount of entities to their concentration gradient. The average distance s traversed in time t depends on D, according to the expression: $s=(4Dt)^{1/2}$. Thus, a single water molecule diffuses an average distance of 98 micrometers per second at 25° C. This rate discloses that a water molecule in a water solution can traverse a channel or reaction chamber having a diameter of 100 micrometers extremely quickly, i.e., in approximately 1.0 second. In a microreaction system, the average distance s is extremely long relative to the dimensions of the internal structures of the system. Accordingly, diffusion is dominant, and profiles of concentration are essentially linear and time-independent. Similar principles apply in chemical diffusion, which is the diffusion under the influence of a gradient in chemical composition. In other words, in a microreaction system, the force driving the interdiffusion of two or more miscible reagents nearly instantaneously eliminates any concentration gradients. Similarly, gradients relating to other physical properties, including temperature and pressure, are nearly instantaneously eliminated. A microreaction system, therefore, can equilibrate nearly instantaneously both thermally and compositionally. Accordingly, such a system is highly responsive and allows for very precise control of reaction conditions, improving reaction kinetics and reaction product selectivity. Such a system allows also for a high degree of repeatability and process optimization. These factors in combination significantly improve yields and reduce processing times.

Third, a microreaction system may also alter chemical behavior for the purpose of enhancing performance. Some microreaction systems include extremely minuscule reaction vessels, cavities, or clefts that can partially encapsulate molecules of a reagent, thereby providing an environment in which interaction via molecular forces can modify the electronic structure of reagent molecules. Steric interactions are possible also, including those that influence the conformation of a reagent molecule or those that affect the free rotation of a chemical group included in a reagent molecule. Such interactions modify the reactivity of the reagents and can actively change the chemistry underlying the chemical process by altering the mechanism of the reaction.

Other advantages of using a microreaction system, instead of a conventional (macroscale) system, include increased portability, decreased reagent consumption, and decreased hazardous waste generation. In sum, microreaction systems, due at least in part to their small size and efficiency, facilitate the synthesis of fine chemicals at, or proximate to, the site of consumption. Such systems are capable of providing on-site and on-demand synthesis of fine chemicals, including radiopharmaceuticals.

More recently, in 2002, a scientific article disclosed the development of "high-density microfluidic chips that contain plumbing networks with thousands of micromechanical valves and hundreds of individually addressable reaction chambers." T. Thorsen, S. J. Maerkl, S. R. Quake, *Microfluidic Large-Scale Integration, Science*, Vol. 298, no. 5593 (Oct. 18, 2002) pp. 580-584. The article disclosed also that "[t]hese fluidic devices are analogous to electronic integrated circuits fabricated using large-scale integration." Not surprisingly, at least one manufacturer of high-density microfluidic chips (Fluidigm Corporation) refers to them as integrated fluidic circuits (IFCs). The term microfluidics generally is used broadly to refer to the study of fluid behavior in microscale, nanoscale, or even picoscale systems. As is common in the terminology of emerging scientific or engineering disciplines, there is no unanimity on a definition of microfluidics, and there likely is at least some overlap between microfluidics and the discipline of microreaction technology described previously. Generally, a microfluidic system is distinguishable in that it processes fluids on a chip that defines a fluidic circuit, where the chip is under digital control and the fluid processing is performed using the fluidic circuit, which includes at least one reaction channel, chamber, compartment, reservoir, vessel, or cleft having at least one cross-sectional dimension (e.g., diameter, depth, length, width, height) on the order of micrometers, nanometers, or even picometers for altering fluid behavior and, possibly, chemical behavior for the purpose of enhancing performance. Accordingly, a microfluidic system enjoys the advantages inherent in a microreaction system that were set forth previously. At least some microfluidic systems can be thought of as including a fluidic chip that incorporates a microreactor. Microfluidic systems are able to exercise digital control over, among other things, the duration of the various stages of a chemical process, leading to a well-defined and narrow distribution of residence times. Such control also enables extremely precise control over flow patterns within the system. Thus, within a single microfluidic chip, especially one with integrated microvalves, the automation of multiple, parallel, and/or sequential chemical processes is possible. Microfluidic chips generally are manufactured at least in part using lithography (e.g., photolithography, multi-layer soft lithography).

In 2005, a scientific article disclosed the development of "a microfluidic chemical reaction circuit capable of executing the five chemical processes of the syntheses of both [$^{18}$F]FDG and [$^{19}$F]FDG within a nanoliter-scale reaction vessel." C.-C. Lee, et al., *Multistep Synthesis of a Radiolabeled Imaging Probe Using Integrated Microfluidics, Science*, Vol. 310, no. 5755, (Dec. 16, 2005), pp. 1793-1796. Specifically, the article stated that "[t]he production of [$^{18}$F]FDG [was] based on five sequential chemical processes: (i) concentration of the dilute [$^{18}$F]fluoride mixture solution (<1 ppm, specific activity ~5000 to 10,000 Ci/mmol), obtained from the proton bombardment of [$^{18}$O]water at a cyclotron facility; (ii) solvent exchange from water to acetonitrile (MeCN); (iii) [$^{18}$F]fluoride substitution of the triflate group in the D-mannose triflate precursor in dry MeCN; (iv) solvent exchange from MeCN to water; and (v) acidic hydrolysis of the fluorinate intermediate to obtain [$^{18}$F]FDG." Regarding step (i), the article stated further that "an in situ ion-exchange column was combined with a rotary pump to concentrate radioisotopes by nearly three orders of magnitude, thereby optimizing the kinetics of the desired reactions." Beyond the five sequential chemical processes, the article disclosed that the microfluidic chip incorporated "digital control of sequential chemical steps, variable chemical environments, and variable physical conditions" and had "the capability of synthesizing the equivalent of a single mouse dose of [$^{18}$F]FDG on demand." The chip also "accelerate[d] the synthetic process and reduce[d] the quantity of reagents and solvents required." The article disclosed further that "[t]his integrated microfluidic chip platform can be extended to other radiolabeled imaging probes." Moreover, the article disclosed "a second-generation chemical reaction circuit with the capacity to synthesize larger [$^{18}$F]FDG doses" that "should ultimately yield large enough quantities (i.e., >100 mCi) of [$^{18}$F]FDG for multiple human PET scans, which typically use 10 mCi per patient."

Additionally, Nanotek, LLC, a company based in Walland, Tenn., manufactures and distributes a microfluidic device called the MinuteManLF. This commercially-available state-of-the-art microfluidic device can synthesize [$^{18}$F]FDG in as little as 100 seconds, while obtaining percent yields as high as 98%. Additionally, the MinuteManLF can be used to synthesize [$^{18}$F]fluoro-3'-deoxy-3'-L-fluorothymidine ([$^{18}$F]FLT), a PET biomarker that is particularly useful for monitoring tumor growth and response by enabling in vivo quantitative imaging of cellular proliferation.

BRIEF SUMMARY OF THE INVENTION

A low-volume biomarker generator suitable for producing unit doses of ultra-short lived radiopharmaceuticals is described in detail herein and illustrated in the accompanying figures. The low-volume biomarker generator system includes a low-power cyclotron and a radiochemical synthesis system. The cyclotron of the low-volume biomarker generator is optimized for producing radioisotopes useful in synthesizing radiopharmaceuticals in small quantities down to approximately one (1) unit dose. The cyclotron incorporates permanent magnets in place of electromagnets and/or an improved rf system to reduce the size, power requirements, and weight of the cyclotron. The radiochemical synthesis system of the low-volume biomarker is a small volume system optimized for synthesizing the radiopharmaceutical in small quantities of approximately one (1) unit dose. The low-volume biomarker generator provides a system and method for producing a unit dose of a biomarker very efficiently.

In one embodiment, the low-volume biomarker generator includes a radio frequency (rf) system powered by a rectified rf power supply. A rectified input supplies a high voltage transformer to supply power to the rf oscillator. The rf signal produced by the rf system is high peak-to-peak voltage at the resonant frequency of the rf oscillator enveloped by the line voltage frequency. The charged particles are only accelerated during a portion of the line voltage cycle. The resulting rf power supply compensates for reduced activity by increasing the current.

The low-volume biomarker generator includes a small, low-power particle accelerator (hereinafter, "micro-accelerator") for producing approximately one (1) unit dose of a radioisotope that is chemically bonded (e.g., covalently bonded or ionically bonded) to a specific molecule. The system includes a radiochemical synthesis subsystem having at least one microreactor and/or microfluidic chip. The radiochemical synthesis subsystem is for receiving the unit dose of the radioisotope, for receiving at least one reagent, and for synthesizing the unit dose of a biomarker using the unit dose of the radioisotope and the other reagent(s).

The micro-accelerator produces per run a maximum quantity of radioisotope that is approximately equal to the quantity of radioisotope required by the radiochemical synthesis subsystem to synthesize a unit dose of biomarker. Chemical synthesis using microreactors or microfluidic chips (or both) is significantly more efficient than chemical synthesis using conventional (macroscale) technology. Percent yields are higher and reaction times are shorter, thereby significantly reducing the quantity of radioisotope required in synthesizing a unit dose of biomarker. Accordingly, because the micro-accelerator is for producing per run only such relatively small quantities of radioisotope, the maximum power of the beam generated by the micro-accelerator is approximately two to three orders of magnitude less than that of a conventional particle accelerator. As a direct result of this dramatic reduction in maximum beam power, the micro-accelerator is significantly smaller and lighter than a conventional particle accelerator, has less stringent infrastructure requirements, and requires far less electricity. Additionally, many of the components of the small, low-power accelerator are less costly and less sophisticated, such as the magnet, magnet coil, vacuum pumps, and power supply, including the RF oscillator.

The synergy that results from combining the micro-accelerator and the radiochemical synthesis subsystem having at least one microreactor and/or microfluidic chip cannot be overstated. This combination, which is the essence of the biomarker generator system, provides for the production of approximately one (1) unit dose of radioisotope in conjunction with the nearly on-demand synthesis of one (1) unit dose of a biomarker. The biomarker generator system is an economical alternative that makes in-house biomarker generation at, or proximate to, the imaging site a viable option even for small regional hospitals.

During operation, ions are continuously generated by the ion source. A filament located in the ion source assembly creates ions which include both positively charged ions and negatively charged ions. As the positive ions enter the vacuum chamber, they gain energy due to a negatively charged alternating electric field induced on the dees. As the positive ions flow from the ion source, they are exposed to the magnetic field generated by the array of permanent magnets. Because these are charged particles in a magnetic field, the positive ions move in roughly a circular path. The positive ions are attracted as they enter a negatively charged dee. As the ions exit, the dee is positively charged, and the ions are repelled by such dee. Each time the particles pass through the gap approaching the dees and as they leave the dee and pass through the magnets, they gain energy, so the orbital radius continuously increases and the particles follow an outwardly spiraling path.

The present invention is an improved cyclotron for producing radioisotopes especially for use in association with medical imaging. The improved cyclotron is configured without the inclusion of a conventional electromagnetic coil of the cyclotron. Accordingly, the weight and size of the present invention is substantially reduced as compared to conventional cyclotrons. Further, the electric power needed to excite the conventional cyclotron magnet is eliminated, thereby substantially reducing the power consumption of the improved cyclotron.

The improved cyclotron includes an upper platform and a lower platform. Each of the upper and lower platforms defines a recess on the interior side thereof, such that as the upper and lower platforms are engaged, the recesses define a vacuum chamber. A circular array of permanent magnets is disposed within each of the recesses. A circular array of dees is disposed within the vacuum chamber, with one dee being disposed between corresponding pairs of permanent magnets in alternating fashion.

Each dee defines a proximal end oriented toward the center of the array and an oppositely disposed distal end. Likewise, each permanent magnet defines a proximal end oriented proximate the center of the array, and an oppositely disposed distal end. Each of the dees is positioned in a valley between the permanent magnets and defines a channel through which ions travel as they are accelerated by the improved cyclotron. When the upper and lower platforms are engaged, a gap is defined between corresponding permanent magnets of the upper and lower platforms such that a substantially homogeneous height channel is defined around the entirety of the vacuum chamber to define an unobstructed flight path for the ions being accelerated therein.

A centrally disposed opening is defined in the upper and lower platforms for the introduction of an ion source. The ion source opening is disposed such that an ion source may be introduced at the center point of the circular array of alternating dees and permanent magnets. Upon the excitation of an ion from the ion source, selected ions are introduced into a first channel defined in the proximal end of a first dee. The channel defines an outlet into the gap between corresponding permanent magnets carried by the upper and lower platforms. A second channel is defined within the proximal end of a second dee. Similarly, a third channel is defined with the proximal end of a third dee. The first, second and third channels are configured to define the first revolution of selected ions through the vacuum chamber. Ions excited which are not at the desired initial energy level and polarity are rejected by not allowing such ions to enter the first channel. After exiting the third channel, the ions traverse through the channel defined by each of the dees until the desired energy level is accomplished.

Each of the dees is subjected to an oscillating voltage such that the polarity of each oscillates. As a result, as an ion approaches the dee, the energy level is predictably increased, as are the speed and radius of travel. Upon exiting a dee the ion is further accelerated and the ions drift through the magnetic field created between corresponding permanent magnets. Upon attaining the desired energy level, ions collide with a target placed in the path of the ion. An oscillator is provided in connection with each of the dees for oscillating the polarity of each in order to accomplish the acceleration of the ion stream. A dee support is electrically connected between each of the dees and the oscillator.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A low-volume biomarker generator suitable for producing unit doses of ultra-short lived radiopharmaceuticals is described in detail herein and illustrated in the accompanying figures. The low-volume biomarker generator system includes a low-power cyclotron and a radiochemical synthesis system. The cyclotron of the low-volume biomarker generator is optimized for producing radioisotopes useful in synthesizing radiopharmaceuticals in small quantities down to approximately one (1) unit dose. The cyclotron incorporates permanent magnets in place of electromagnets and/or an improved rf system to reduce the size, power requirements, and weight of the cyclotron. The radiochemical synthesis system of the low-volume biomarker is a small volume system optimized for synthesizing the radiopharmaceutical in small quantities of approximately one (1) unit dose.

Figure 11:
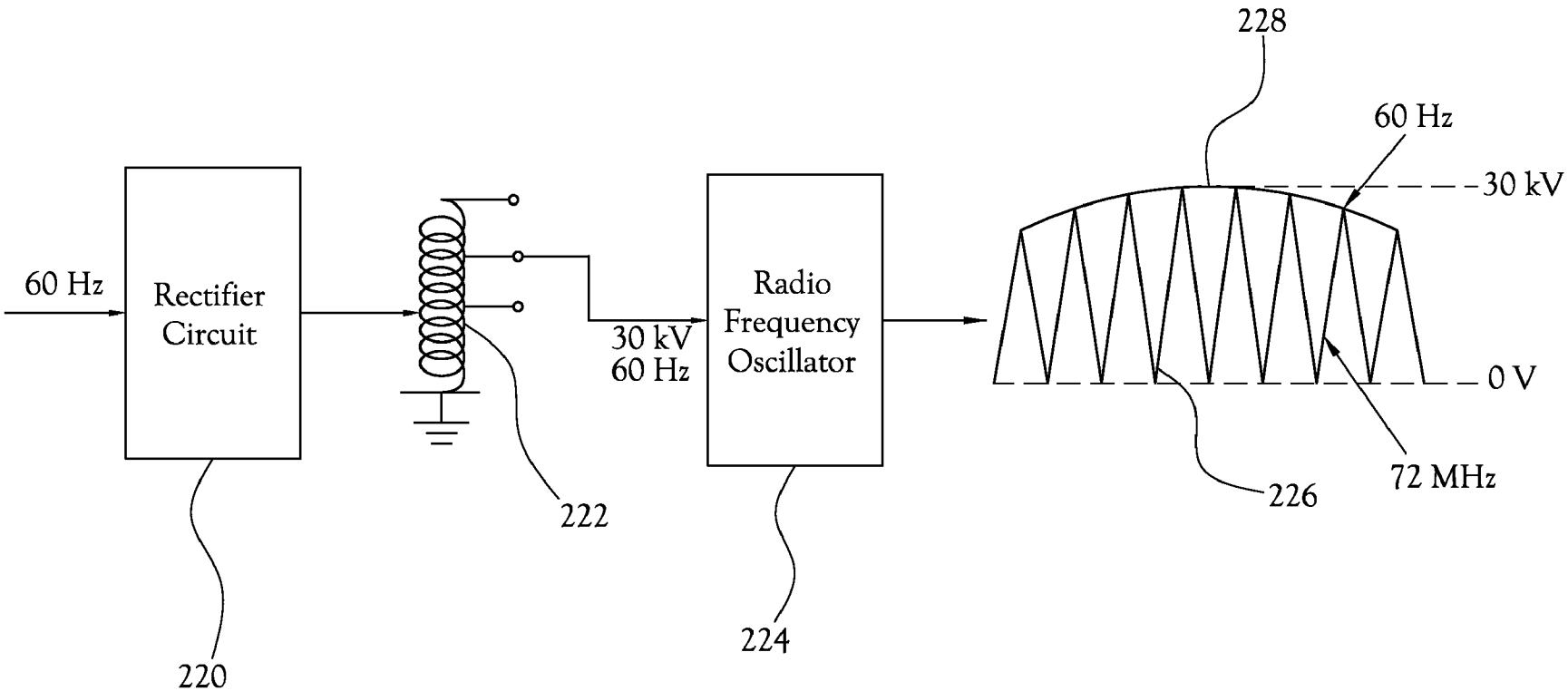
FIG. 11 illustrates one embodiment of radio frequency system for a cyclotron suitable for use in the low-volume biomarker generator described herein.

FIG. 11 is a block diagram of one embodiment of the radio frequency system of the cyclotron in the low-volume biomarker generator. The radio frequency system includes rectifier circuit 220 that accepts line voltage and produces a rectified voltage signal. The rectifier circuit 220 is a full wave rectifier incorporating two or more diodes, such as a dual diode rectifier. In one embodiment, the rectified voltage signal is the positive portion of the line voltage. The rectified voltage signal supplies the input of a high voltage step-up transformer 222 capable of supplying a high voltage and high current rf supply signal. In one embodiment, the step-up transformer is an autotransformer producing an output voltage of 30 kV at the line voltage frequency, e.g., 60 Hz. The rf oscillator 224 uses the rf supply signal to produce an rf signal at a selected frequency based on the resonance frequency of the rf oscillator 224 and having a peak-to-peak voltage corresponding to the peak voltage of the rf supply signal. The resonance frequency and the peak-to-peak voltage are selected to accelerate the charged particles to a selected energy level. In the illustrated embodiment, the resonance frequency of the rf oscillator is 72 MHz producing an rf signal having a frequency of 72 MHz with a maximum peak-to-peak voltage of 30 kV enveloped in the 60 Hz line voltage frequency.

The resulting rf signal drives the polarity of the dees to accelerate the charged particles. However, acceleration of positively charged particles occurs only during the positive portion of the 60 Hz cycle. By applying full wave rectification, the acceleration periods occur twice as often. For the production of radioisotopes useful in positron emission tomography imaging, only small amounts of activity are necessary. By increasing the beam current, the cyclotron compensates for having acceleration during only a small portion of the 60 Hz cycle.

In another embodiment of the low-volume biomarker generator, the cyclotron is configured such that the conventional electromagnetic coil is obviated. Accordingly, the weight and size of the present invention is substantially reduced as compared to conventional cyclotrons. Also, the electric power needed to excite the conventional cyclotron magnet is eliminated.

Figure 4:
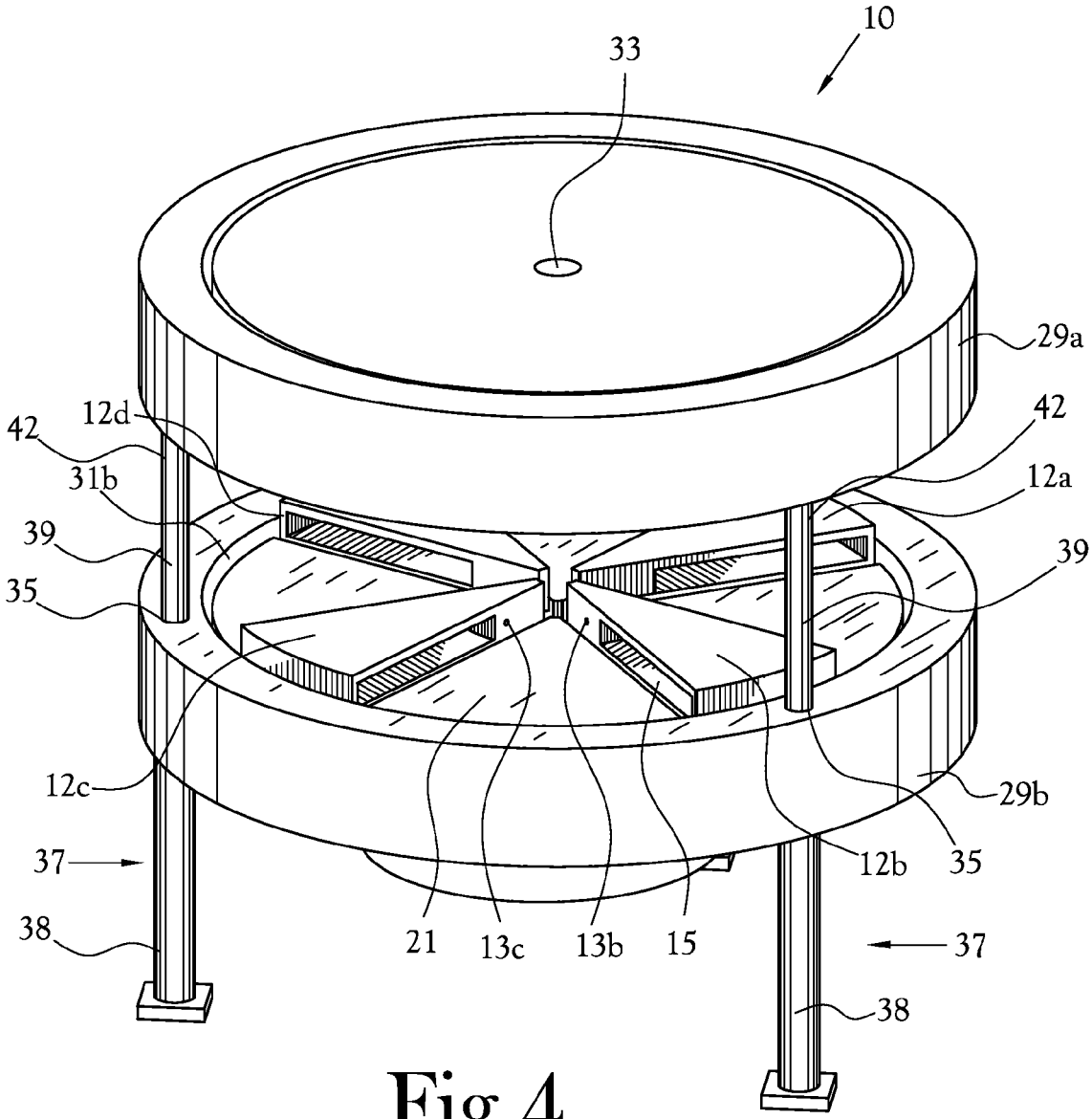
FIG. 4 is a perspective view of the improved cyclotron of the present invention, showing an upper platform disposed above a lower platform in an open orientation, the improved cyclotron constructed in accordance with several features of the present invention.
Figure 5:
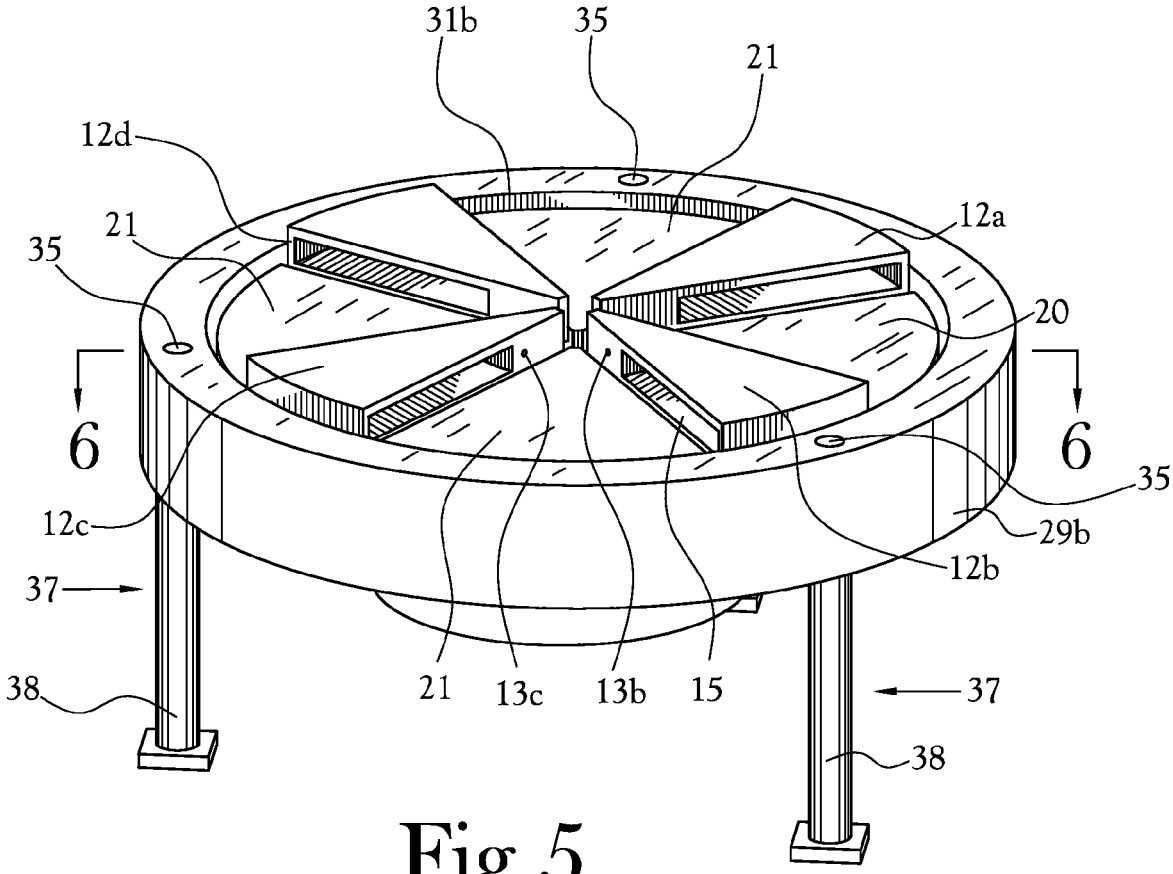
FIG. 5 is a perspective view of the lower platform of the improved cyclotron of the present invention, constructed in accordance with several features of the present invention.

FIGS. 4 and 5 illustrate the primary components of the improved cyclotron 10 of the present invention. Generally, the improved cyclotron 10 includes an upper platform 29*a* and a lower platform 29*b*. The lower platform 29*b* is more clearly illustrated in FIG. 5. Each of the upper and lower platforms 29*a*, 29*b* defines a recess 31*a*, 31*b* on the interior side thereof, such that as the upper and lower platforms 29*a*, 29*b* are engaged, the recesses 31*a*, 31*b* define a vacuum chamber 27. A circular array of permanent magnets 20 is disposed within each of the recesses 31*a*, 31*b*. Between respective pairs of the permanent magnets 20 are "valleys". A circular array of dees 12 is disposed within the vacuum chamber 27, with one dee 12 being disposed in each valley between corresponding pairs of the permanent magnets 20, i.e., a permanent magnet 20 carried by the upper platform 29*a* and a corresponding permanent magnet carried by the lower platform 29*b*, in alternating fashion. In the illustrated embodiment, each of the permanent magnets 20 and the dees 12 define a wedge-shaped configuration.

Each dee 12 defines a proximal end 16 oriented toward the center of the array and an oppositely disposed distal end 18. Likewise, each permanent magnet 20 defines a proximal end 23 oriented proximate the center of the array, and an oppositely disposed distal end 25. Each of the dees 12 defines a channel 14 through which ions travel as they are accelerated by the improved cyclotron 10. When the dees 12 are disposed with the vacuum chamber 27, the top surface of the permanent magnets 20 is disposed in substantially the same plane as a side wall of the dee channel 14. When the upper and lower platforms 29*a*, 29*b* are engaged, a gap is defined between corresponding permanent magnets 20 of the upper and lower platforms 29*a*, 29*b*. Accordingly, a substantially homogeneous height channel is defined around the entirety of the vacuum chamber 27 to define an unobstructed flight path for the ions being accelerated therein.

A centrally disposed opening 33 is defined in the upper and lower platforms 29*a*, 29*b* for the introduction of an ion source 82. The ion source opening 33 is disposed such that an ion source 82 may be introduced at the center point of the circular array of alternating dees 12 and permanent magnets 20.

Illustrated is a plurality of legs 37 disposed under the lower platform 29*b*. In this embodiment, each leg 37 is defined by the cylinder body 38 of a pneumatic or hydraulic cylinder. The lower platform 29*b* defines a plurality of through openings 35 for slidably receiving a piston rod 39 of each of the cylinders 38. A distal end 42 of each piston rod 39 is connected to the upper platform 29*a*. Thus, engagement of the upper and lower platforms 29*a*, 29*b* is accomplished by retraction of the piston rods 42 into the respective cylinders 38. Separation of the upper and lower platforms 29*a*, 29*b* is accomplished in part by extending the piston rods 42 from within the cylinders 38. While this construction is disclosed, it will be understood that other configurations are contemplated as well.

Figure 2:
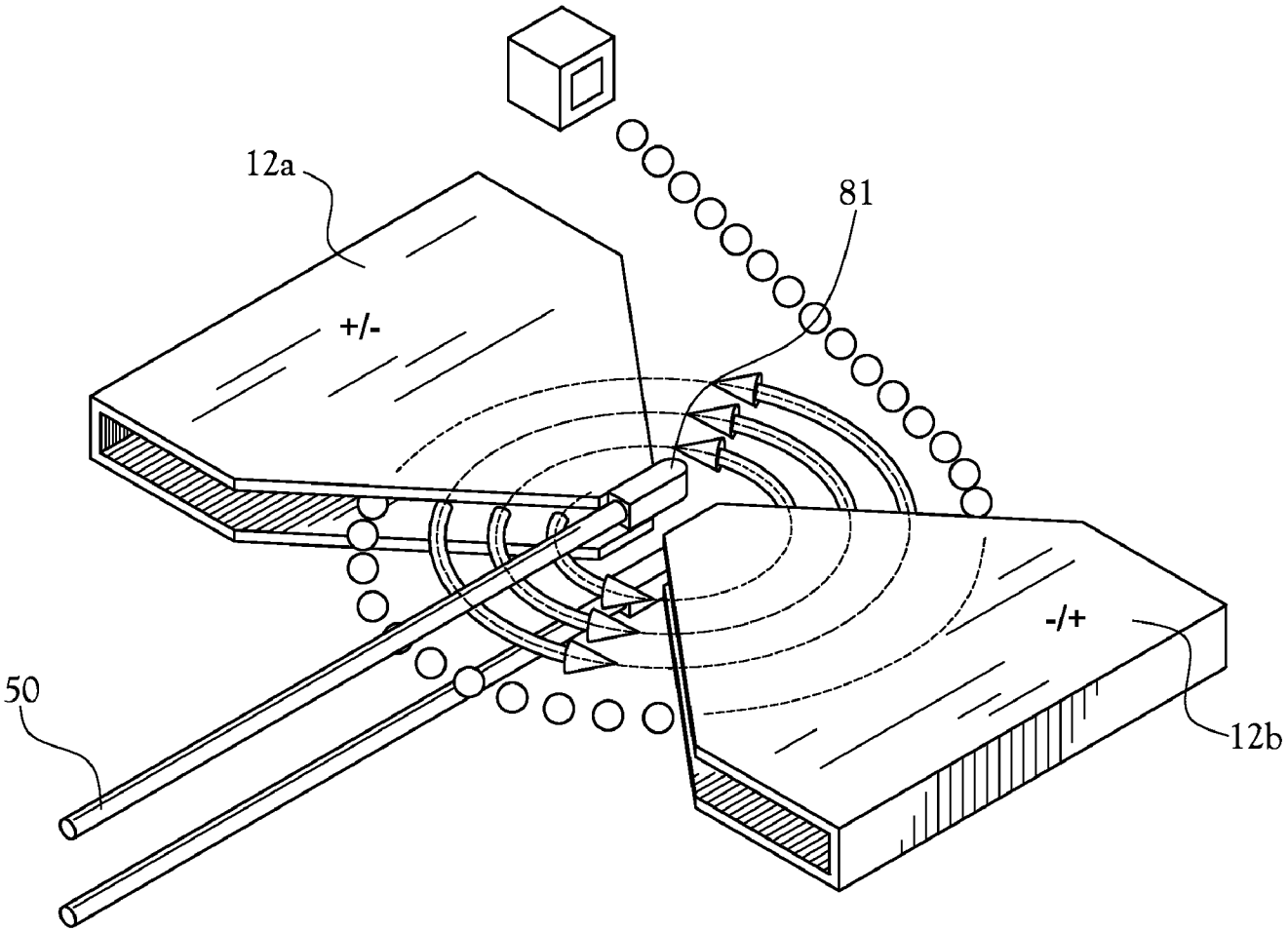
Fig.2 (PRIOR ART)
FIG. 2 is a perspective view of the ionization and acceleration components disposed within a conventional cyclotron.

Referring to FIG. 2, the flight path of an ion is more clearly illustrated. Upon the excitation of an ion from the ion source 82, selected ions are introduced into a first collimator channel 13*a* defined in the proximal end 16 of a first dee 12*a*. The first collimator channel 13*a* defines an outlet into the gap between corresponding permanent magnets 20 carried by the upper and lower platforms 29*a*, 29*b*. A second collimator channel 13*b* is defined within the proximal end 16 of the second dee 12*b*. Similarly, a third collimator channel 13*c* is defined with the proximal end 16 of the third dee 12*c*. The first, second and third collimator channels 13*a*, 13*b*, 13*c* are configured to define the first revolution of selected ions through the vacuum chamber 27. Ions excited which are not at the desired initial energy level are rejected by not allowing such ions to enter the first collimator channel 13*a*. After exiting the third collimator channel 13*c*, the ions traverse through the channels 14 defined by each of the dees 12 until the desired energy level is accomplished.

As will be discussed below, each of the dees 12 is subjected to an oscillating voltage such that the polarity of each oscillates. In the illustrated embodiment, a target acceleration voltage of approximately 20 kilovolts or less is applied to the dees 12. As a result, as an ion approaches the dee 12, and as it leaves the dee 12, the energy level is predictably increased. Likewise, the speed is increased, as well as the radius of travel. Upon exiting a dee 12, the ions drift through the magnetic field created between corresponding permanent magnets 20. Because the ions are traveling in a magnetic field, their travel path is substantially circular. Upon attaining the desired energy level, ions are withdrawn from the improved cyclotron 10.

Figure 6:
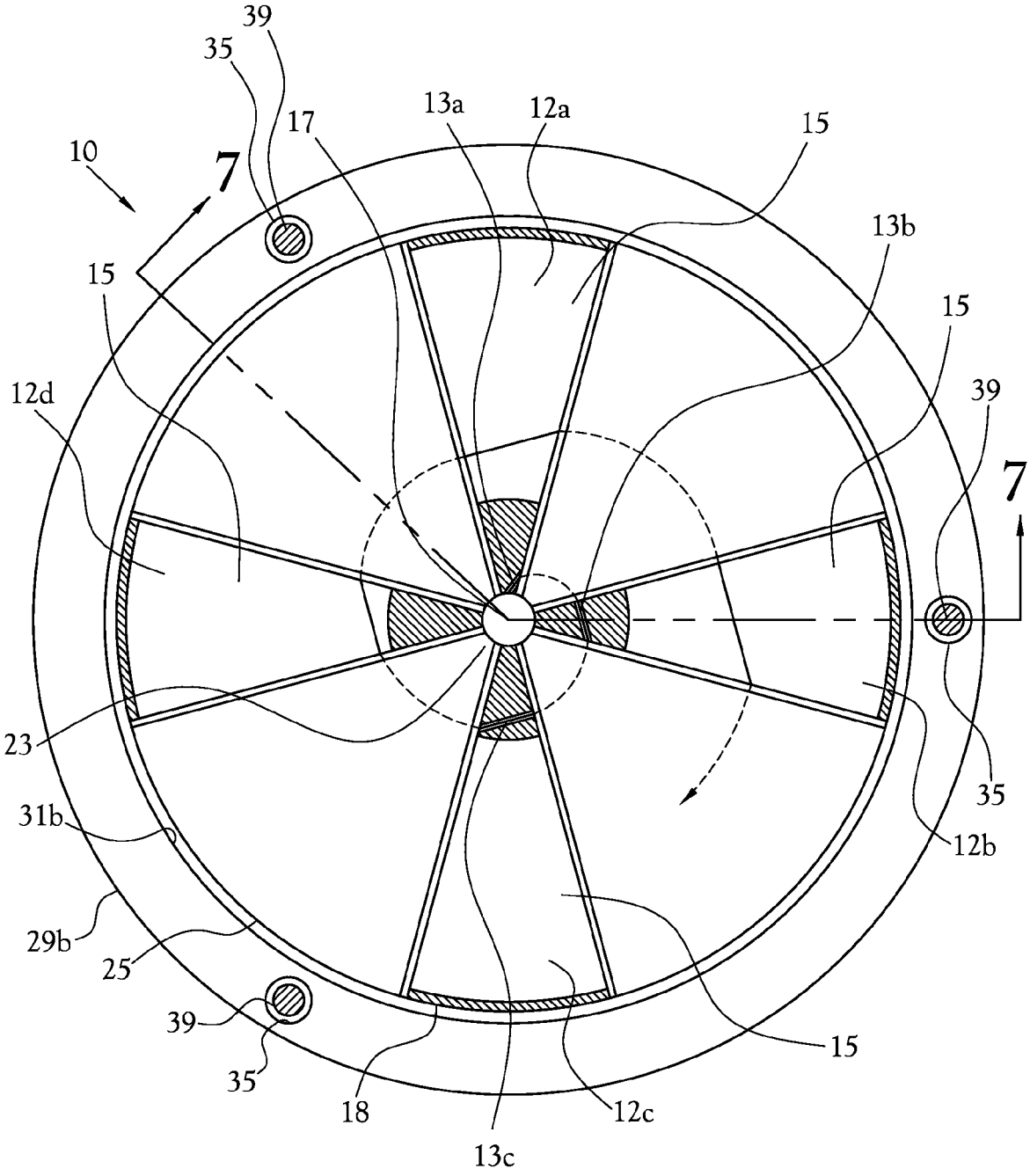
FIG. 6 is a plan view of the lower platform and a cross-sectional view, taken along lines 6-6 of FIG. 5, showing of each of the dees in cross-section and illustrating the flight path of ions accelerated through the improved cyclotron of FIG. 4.
Figure 7:
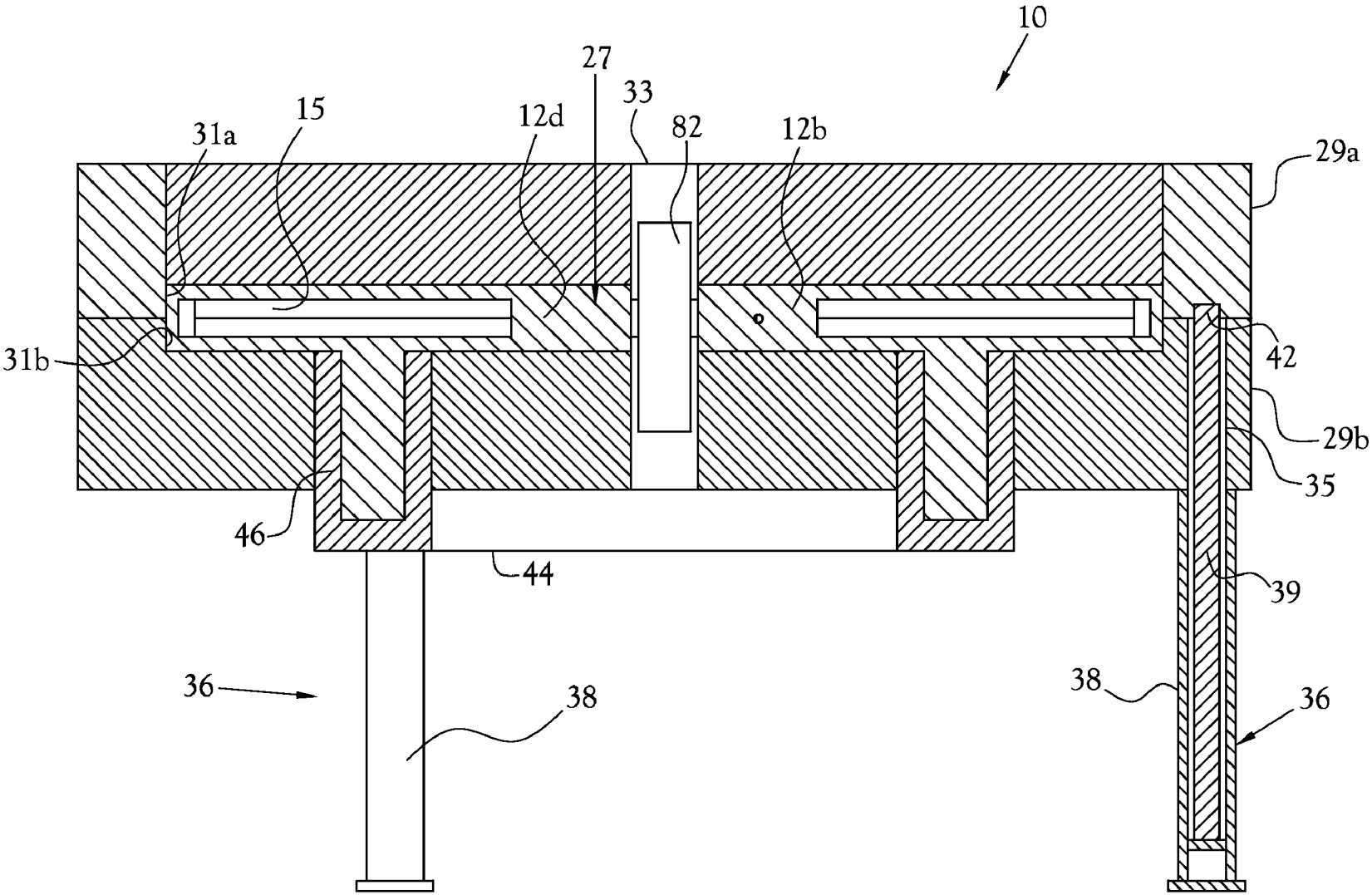
FIG. 7 is an elevation view, in cross-section taken along lines 7-7 of FIG. 6, of the improved cyclotron of FIG. 6 illustrating the upper platform engaged with the lower platform.
Figure 8:
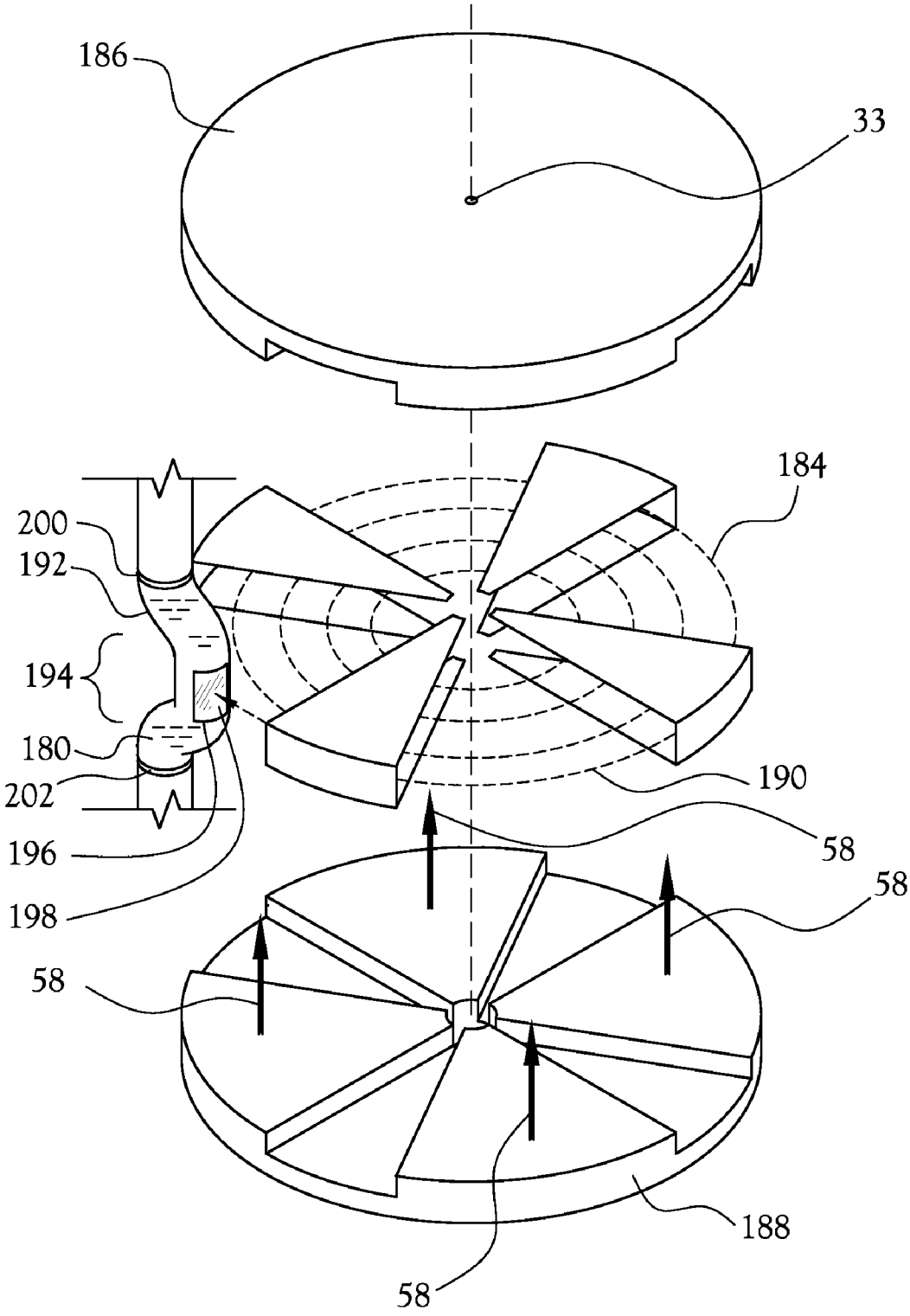
FIG. 8 is an exploded view of a diagrammatic illustration of an embodiment of a four-pole cyclotron having an internal target subsystem.
Figure 9:
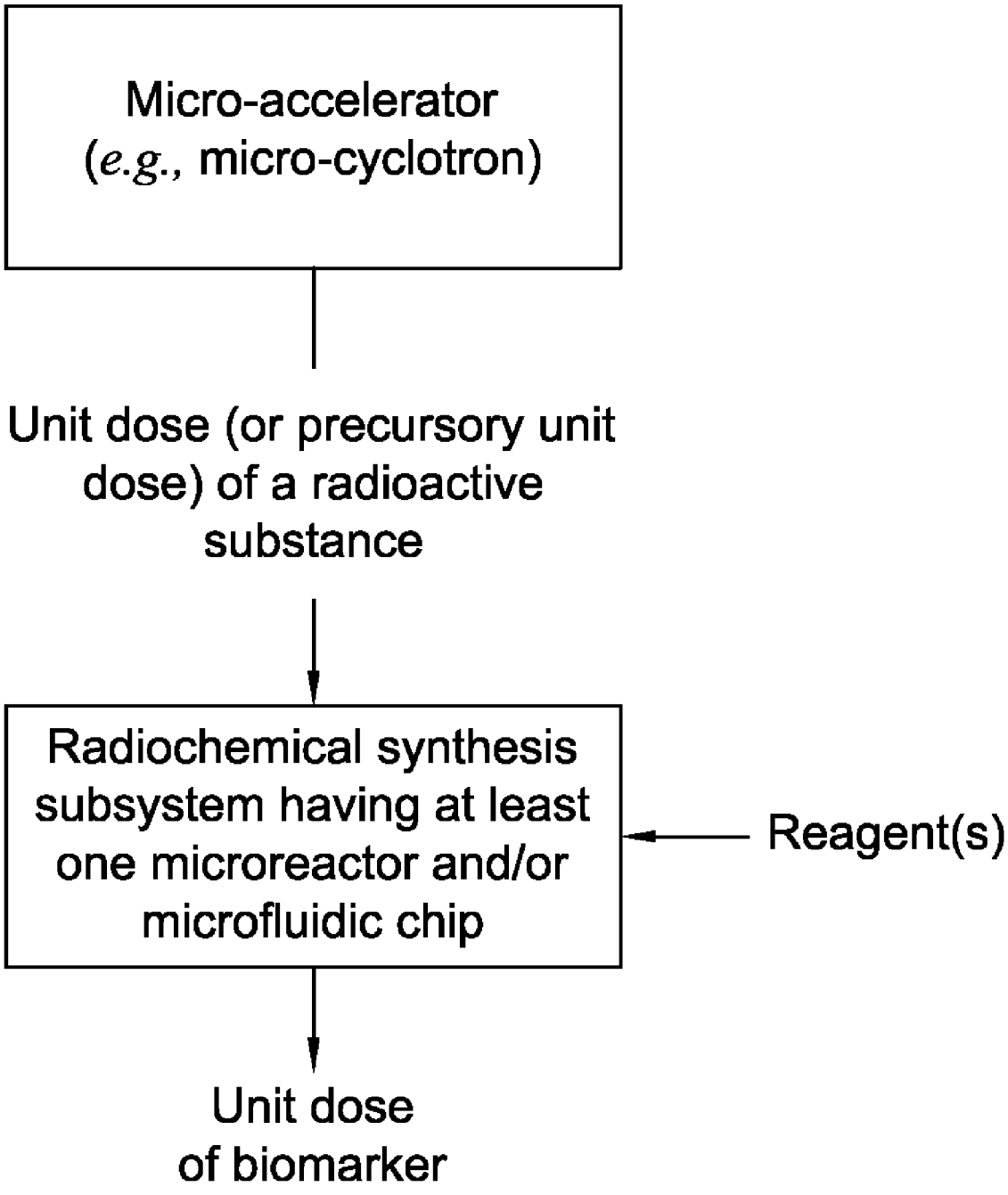
FIG. 9 is a schematic illustration of the system for producing a unit dose of a biomarker.
Figure 10:
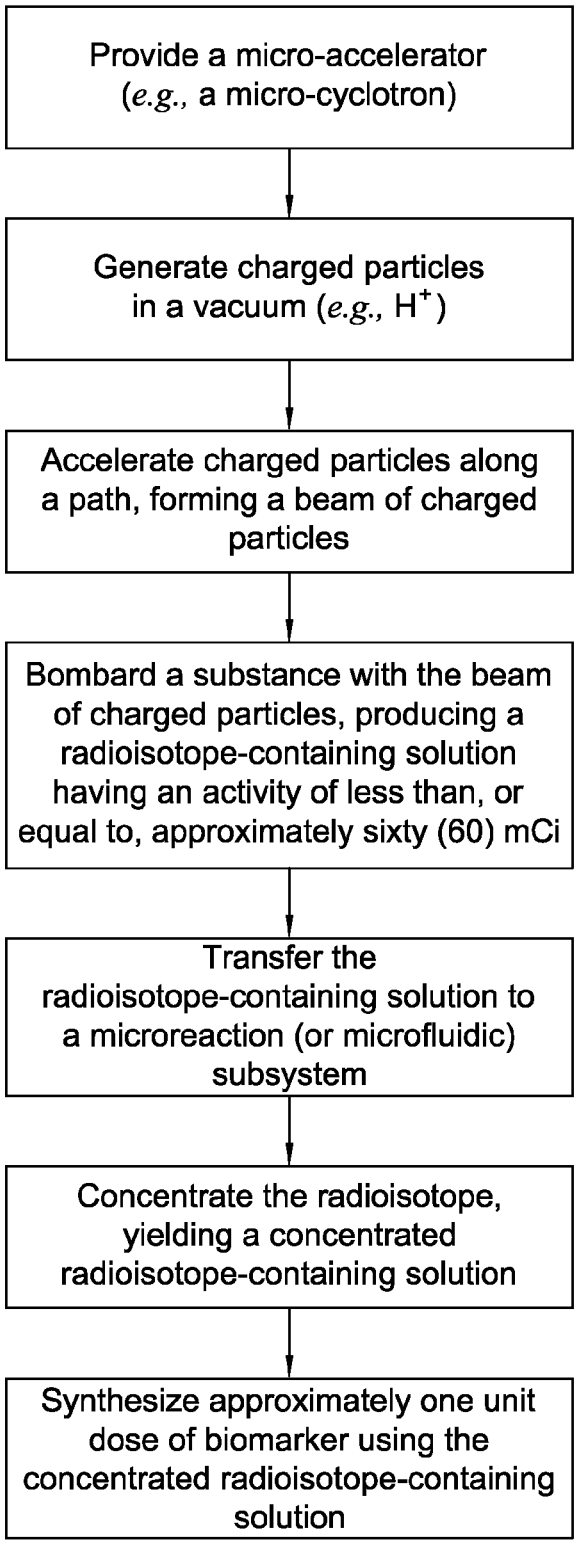
FIG. 10 is a flow diagram of one embodiment of the method for producing approximately one (1) unit dose of a biomarker.

Illustrated in FIG. 6 is a cross-sectional view of one embodiment of the cyclotron 10 of the present invention shown with the upper and lower platforms 29*a*, 29*b* engaged with one another. Each dee 12 defines a channel 14 through which ions travel. Cooperatively, each of the permanent magnets 20 defines a channel through which the ions travel. As an ion passes through a dee 12, it is accelerated. The ion then drifts through the magnet channel. As the ion exits the magnet channel, it is accelerated toward and through the next dee 12.

An oscillator 44 is shown schematically in connection with each of the dees 12. The oscillator 44 is adapted to induce a negatively charged alternating electric field on the dees 12, whereby positive ions generated from an ion source 82 are accelerated within the improved cyclotron 10. The oscillator 44 is provided for oscillating the polarity of each of the dees 12 in order to accomplish the acceleration of the ion stream. To this extent, the lower platform 29*b* defines a plurality of through openings 48. A dee support 46 is electrically connected to each of the dees 12, and is configured and disposed to be received within one of plurality of through openings 48. The dee supports 46 are further electrically connected to the oscillator 44, thereby establishing electrical communication between the oscillator 44 and each of the dees 12. Also illustrated schematically is the ion source 82 received within the central opening 33 defined by the upper and lower platforms 29*a*, 29*b*.

During operation, ions are continuously generated by the ion source 82. The ions gain energy due to a negatively charged alternating electric field induced on the dees 12. As the positive ions flow from the ion source 82, they are exposed to the magnetic field generated by the array of permanent magnets 20. The ions are repelled as they exit a dee 12. As the ions approach a dee 12, they are pulled by such dee 12. Each time the particles pass through the gap approaching the dees 12 and as they leave the dee 12 and pass through the magnets 20, they gain energy, so the orbital radius continuously increases and the particles follow an outwardly spiraling path. To this extent, the positive ions are attracted to a negatively charged dee 12. As the ions exit the dee 12, the dee 12 is then positively charged as a result of the alternating electric field, and is therefore repelled from such dee 12. The ions drift along a roughly circular path through the permanent magnets 20 until they are attracted by the next dee 12. The result is a stream of ions which are accelerated in a substantially circular path spiraling outward.

It will be recognized by those skilled in the art that that the improved cyclotron 10 of the present invention provides substantial improvements with respect to cost and reliability in low-power cyclotrons of accelerated energy of 8-10 MeV, or less. While the improved cyclotron 10 is presently not practical for higher acceleration voltages due to the increased magnetic field requirements of the permanent magnets 20, such embodiments are not excluded from the spirit of the present invention.

Because the present invention allows for the exclusion of the electromagnetic coils of the prior art, the volume of the device is reduced, in one embodiment, by approximately forty percent (40%), with a minimum equipment cost savings of twenty-five percent (25%). Similarly, without the coils, the weight is reduced by approximately forty percent (40%). A significant savings in energy is achieved by eliminating the coils. Energy requirements are further reduced as a result of the lower acceleration voltage of 8-10 MeV or less applied to the dees 12. As a result of these improvements, the reliability of the improved cyclotron 10 is enhanced as compared to cyclotrons of the prior art. As a result of the smaller size and lighter weight, more facilities are capable of operating the present invention, especially in situations where space is of concern. Further, because of the ultimately reduced purchase and operating costs, the improved cyclotron of the present invention is also more affordable.

The target incorporated in the present invention is internal to the improved cyclotron 10, allowing bombardment of ions where the reaction occurs. Further, as a result of the target being internal, there is no radiation exposure due to the extraction mechanism. To further such improvement, the permanent magnets 20 further serve as a radiation shield around the target where most of the radiation is generated, thereby further reducing costs. Because the improved cyclotron 10 is capable of using highly stable positive ions, the vacuum requirements are reduced and the reliability is increased while, again, the cost is reduced. To wit, with respect to the use of positive ions, positive ions are more stable than negative ions, thus lending to the improved reliability of their use. Positive ions require less vacuum as compared to negative ions, thereby requiring less expensive pumps, which enhances both the cost and reliability concerns of the improved cyclotron 10. Positive ions are also easier to generate within the source again decreases the complexity and cost of the ion source.

In one application of the present invention, the improved cyclotron 10 is incorporated in a system for producing a radiochemical, the system also including a radiochemical synthesis subsystem having at least one microreactor and/or microfluidic chip. This is set forth in copending U.S. application Ser. No. 11/441,999, filed May 26, 2006 and entitled "Biomarker Generator System." The disclosure of this application in incorporated herein by reference. The radiochemical synthesis subsystem is provided for receiving the radioactive substance, for receiving at least one reagent, and for synthesizing the radiochemical comprising. In this application, the improved cyclotron 10 generates a beam of charged particles having a maximum beam power of less than, or equal to, approximately fifty (50) watts.

The embodiments of low-volume biomarker generator described above can be employed separately or collectively as required. In other words, the low-volume biomarker generator can incorporate both the permanent magnet system and the radio frequency system described above to take advantage of the benefits derived from each or it can use either the permanent magnet system or the radio frequency system described above and not the other without departing from the scope and spirit of the present invention.

Application of the embodiments of the low-volume biomarker generator described above are discussed in paragraphs that follow. For purposes of this discussion, the these terms are intended to be construed using the definitions below.

The terms "patient" and "subject" refer to any human or animal subject, particularly including all mammals.

The term "radiochemical" is intended to encompass any organic or inorganic compound comprising a covalently-attached radioisotope (e.g., 2-deoxy-2-[$^{18}$F]fluoro-D-glucose ([$^{18}$F]FDG)), any inorganic radioactive ionic solution (e.g., Na[$^{18}$F]F ionic solution), or any radioactive gas (e.g., [$^{11}$C]$CO_2$), particularly including radioactive molecular imaging probes intended for administration to a patient or subject (e.g., by inhalation, ingestion, or intravenous injection) for human imaging purposes, such probes are referred to also in the art as radiopharmaceuticals, radiotracers, or radioligands. These same probes are also useful in other animal imaging.

The term "reactive precursor" refers to an organic or inorganic non-radioactive molecule that, in synthesizing a biomarker or other radiochemical, is reacted with a radioactive isotope (radioisotope), typically by nucleophilic substitution, electrophilic substitution, or ion exchange. The chemical nature of the reactive precursor varies and depends on the physiological process that has been selected for imaging. Exemplary organic reactive precursors include sugars, amino acids, proteins, nucleosides, nucleotides, small molecule pharmaceuticals, and derivatives thereof.

The term "unit dose" refers to the quantity of radioactivity, expressed in millicuries (mCi), that is administered for PET to a particular class of patient or subject. For example, a human adult generally requires a unit dose of biomarker in the range of approximately ten (10) mCi to approximately fifteen (15) mCi. In another example, a unit dose for a small animal such as a mouse may be only a few microcuries (μCi). A unit dose of biomarker necessarily comprises a unit dose of a radioisotope.

The biomarker generator system includes (1) a small, low-power particle accelerator for generating a unit dose of a positron-emitting radioisotope and (2) a radiochemical synthesis subsystem having at least one microreactor and/or microfluidic chip. The radiochemical synthesis subsystem is for receiving the unit dose of the radioisotope, for receiving at least one reagent, and for synthesizing the unit dose of a biomarker using the unit dose of the positron-emitting radioisotope and the reagent(s). Although the following description of the biomarker generator system may emphasize somewhat the production of biomarkers that are labeled with either fluorine-18 ($^{18}F$) or carbon-11 ($^{11}C$), one skilled in the art will recognize that the biomarker generator system is provided for producing unit doses of biomarkers that are labeled with other positron-emitting radioisotopes as well, including nitrogen-13 ($^{13}N$) and oxygen-15 ($^{15}O$). One skilled in the art will recognize that the biomarker generator system is provided also for producing unit doses of biomarkers that are labeled with radioisotopes that do not emit positrons or for producing small doses of radiochemicals other than biomarkers. A description of the small, low-power particle accelerator is followed by a description of the radiochemical synthesis subsystem.

As stated previously, most clinically-important positron-emitting radioisotopes have half-lives that are very short. Consequently, the particle accelerators used in generating these radioisotopes are for producing a large amount of radioisotope, typically on the order of curies (Ci), in recognition of the significant radioactive decay that occurs during the relatively long time that the radioisotope undergoes processing and distribution. Regarding the present invention, the small, low-power particle accelerator (hereinafter, "micro-accelerator") departs significantly from this established practice in that it is engineered to produce per run a maximum amount of radioisotope on the order of millicuries (mCi), which is three orders of magnitude less than a conventional particle accelerator. In most embodiments, the micro-accelerator produces per run a maximum of less than, or equal to, approximately sixty (60) mCi of the desired radioisotope. In one such embodiment, the micro-accelerator produces per run a maximum of approximately eighteen (18) mCi of fluorine-18. In another such embodiment, the micro-accelerator produces per run a maximum of approximately five (5) mCi of fluorine-18. In another such embodiment, the micro-accelerator produces per run a maximum of approximately thirty (30) mCi of carbon-11. In still another such embodiment, the micro-accelerator produces per run a maximum of approximately forty (40) mCi of nitrogen-13. In still another such embodiment, the micro-accelerator produces per run a maximum of approximately sixty (60) mCi of oxygen-15. Such embodiments of the micro-accelerator are flexible in that they can provide a quantity of radioisotope adequate, or slightly more than adequate, for the each of various classes of patients and subjects that undergo PET, including, for example, human adults and children, which generally require between approximately five (5) and approximately fifteen (15) mCi of radioactivity per unit dose of biomarker, and small laboratory animals, which generally require approximately one (1) mCi of radioactivity per unit dose of biomarker.

A particle accelerator for producing per run a maximum of less than, or equal to, approximately sixty (60) mCi of radioisotope requires significantly less beam power than a conventional particle accelerator, which typically generates a beam having a power of between 1,400 and 2,160 watts (between 1.40 and 2.16 kW) and typically having a current of approximately 120 microamperes (μA) and typically consisting essentially of charged particles having an energy of approximately 11 to approximately 18 MeV (million electron volts). Specifically, all embodiments of the micro-accelerator generate a beam having a maximum power of only less than, or equal to, approximately fifty (50) watts. In one such embodiment, the micro-accelerator generates an approximately one (1) μA beam consisting essentially of protons having an energy of approximately seven (7) MeV, the beam having beam power of approximately seven (7) watts and being collimated to a diameter of approximately one (1) millimeter. As a direct result of the dramatic reduction in maximum beam power, the micro-accelerator is significantly smaller and lighter than a conventional particle accelerator and requires less electricity. Many of the components of the micro-accelerator are less costly and less sophisticated, such as the magnet, magnet coil, vacuum pumps, and power supply, including the RF oscillator. In some embodiments, the micro-accelerator has an electromagnet that has a mass of only approximately three (3) tons, as opposed to between ten (10) and twenty (20) tons, which represents the mass of an electromagnet typical of a conventional particle accelerator used in PET. In other embodiments, a permanent magnet is used instead of the customary electromagnet, eliminating the need for the magnet coil, further reducing the size, mass, and complexity of the micro-accelerator. The overall architecture of the micro-accelerator may vary, also. In some embodiments, the micro-accelerator is a two-pole cyclotron. In other embodiments, it is a four-pole cyclotron. One skilled in the art will recognize that it may be advantageous to use a four-pole cyclotron for certain applications, partly because a four-pole cyclotron accelerates charged particles more quickly than a two-pole cyclotron using an equivalent accelerating voltage. One skilled in the art will recognize also that other types of particle accelerators may function as a micro-accelerator. Such particle accelerators include linear accelerators, radiofrequency quadrupole accelerators, and tandem accelerators. Subtler variations in the micro-accelerator are described in the next few paragraphs.

One skilled in the art will acknowledge that, in an accelerating field, beams of positively-charged particles generally are more stable than beams of negatively-charged particles. Specifically, at the high velocities that charged particles experience in a particle accelerator, positively-charged particles are more stable, as they either have no electrons to lose (e.g., $H^+$) or, because of their electron deficit, are less likely to lose electrons than are negatively-charged particles. When an electron is lost, it usually causes the charged particle to strike an interior surface of the particle accelerator, generating additional radiation, hence increasing the shielding necessary to reduce radiation outside the particle accelerator to acceptable levels. Therefore, in some embodiments, the micro-accelerator has an ion source system optimized for proton ($H^+$) production. In other embodiments, the micro-accelerator has an ion source system optimized for deuteron ($^2H^+$) production. In still other embodiments, the micro-accelerator has an ion source system optimized for alpha particle ($He^{2+}$) production. One skilled in the art will recognize that particle accelerators that accelerate only positively-charged particles require significantly less vacuum pumping equipment, thus further reducing the particle accelerator's size, mass, and complexity. One skilled in the art will recognize also, however, that the acceleration of negatively-charged particles is necessary for certain applications and requires a micro-accelerator having an ion source system appropriate for that purpose.

Figure 1:
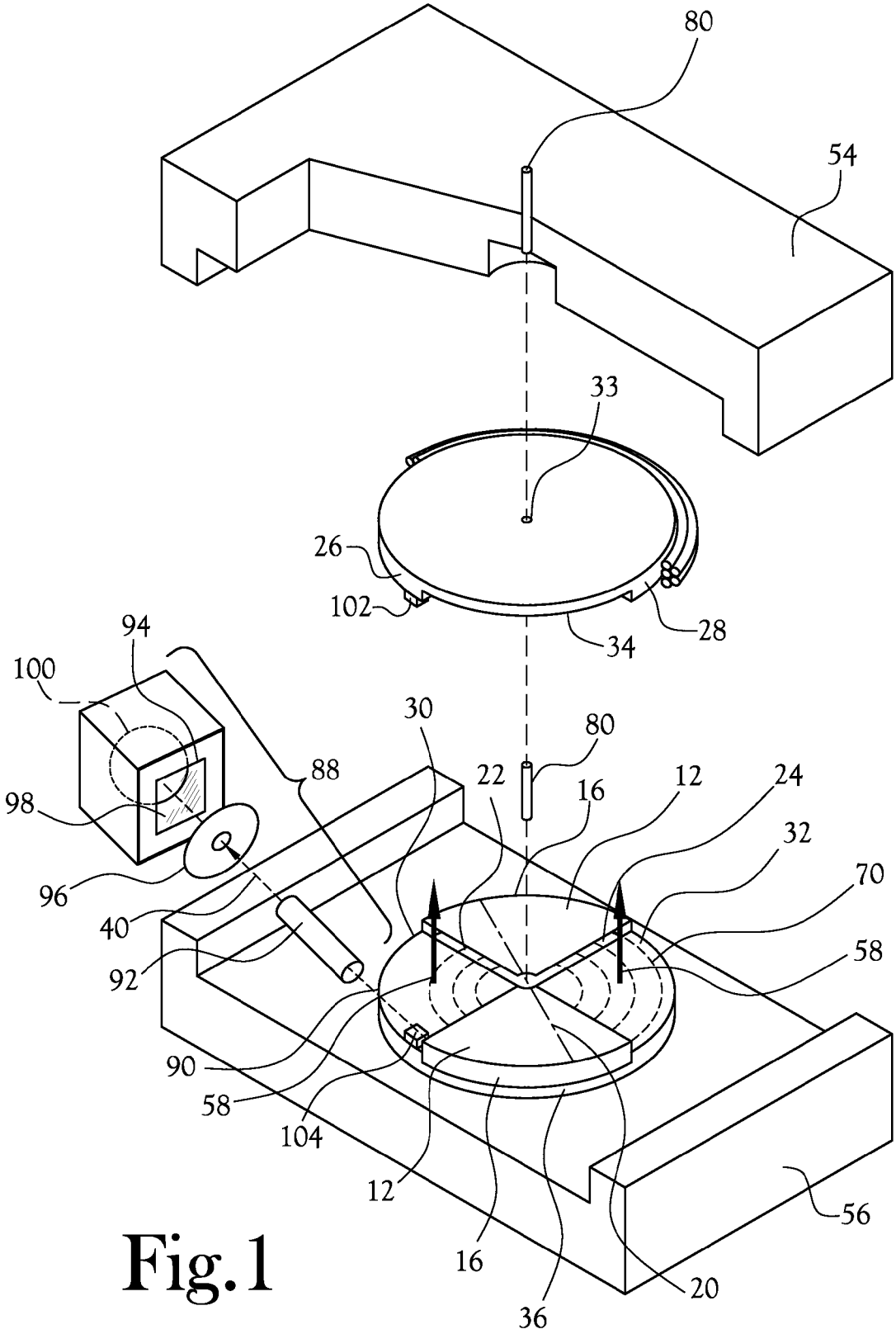
Fig.1 (PRIOR ART)
FIG. 1 is an exploded view of a diagrammatic illustration of certain components of a prior art cyclotron.
Figure 3:
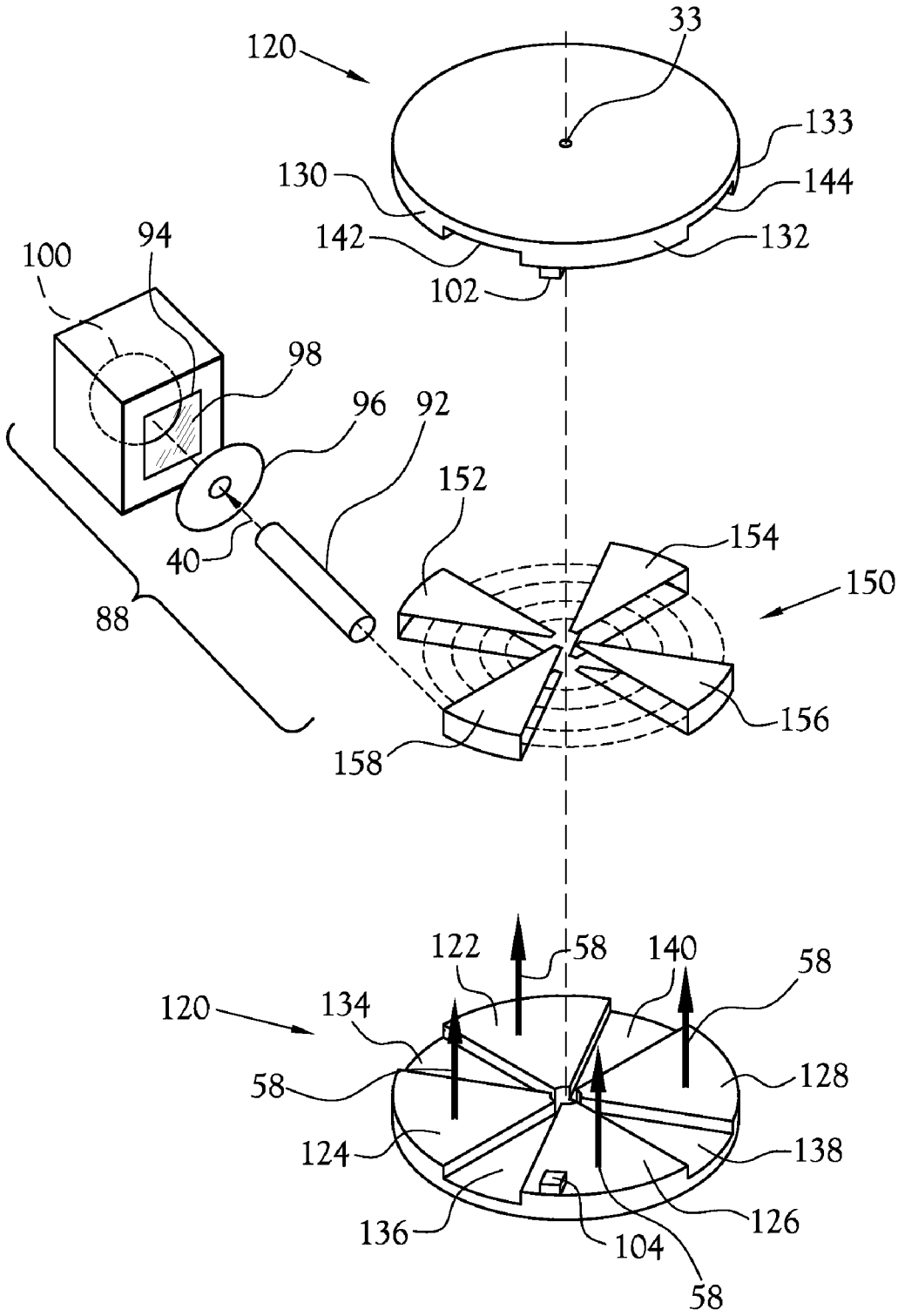
Fig.3 (PRIOR ART)
FIG. 3 is an exploded view of a diagrammatic illustration of certain components of a prior art four-pole cyclotron.

As stated previously, and as depicted in FIG. 1, during the operation of a cyclotron having a conventional target system, the high-energy beam exits the magnetic field 58 at the predetermined location 90 and enters the accelerator beam tube 92, which is aligned with the target entrance 94. In FIG. 3, however, which depicts one embodiment of the micro-accelerator, the target substance 180 is located within the magnetic field 182 (hereinafter, "internal target"). In this embodiment, the beam 184 never escapes the magnetic field 182. Consequently, the magnet subsystem, including the electromagnets 186, 188, is able to assist in containing harmful radiation related to the nuclear reaction that converts the target substance 180 into a radioisotope. Additionally, the internal target subsystem reduces radiation by eliminating a major source of radiation inherent in a conventional (external target)

positive-ion cyclotron. Inevitably, in such a cyclotron, some of the charged particles that comprise the beam strike the metal blocks (i.e., the magnet extraction mechanism) used in extracting the beam from the acceleration chamber, generating a significant amount of harmful radiation. A positive-ion cyclotron having an internal target subsystem does not require any such extraction mechanisms. In their absence, much less harmful radiation is generated, reducing the need for shielding. Thus, the internal target subsystem eliminates a considerable disadvantage for positive-ion cyclotrons. Although one skilled in the art will recognize that the internal target subsystem may used for any of a wide variety of applications, an internal target subsystem appropriate for fluorine-18 generation using a proton beam is summarized below because fluorine-18 is required for the production of [$^{18}$F]FDG, the positron-emitting radiopharmaceutical most widely used in clinical applications.

In this embodiment of the micro-accelerator, the target substance 180 is a solution comprising [$^{18}$O]water. The target substance 180 is conducted by a stainless steel tube 192. The stainless steel tube 192 is secured such that a section of it (hereinafter, "target section" 194) is centered in the path 190 that the beam 184 travels following the final increment of acceleration. Additionally, the longitudinal axis of the target section 194 is approximately parallel to the magnetic field 182 generated by the magnet subsystem and approximately perpendicular to the electric field generated by the RF subsystem. The remainder of the stainless steel tube is selectively shaped and positioned such that it does not otherwise obstruct the path followed by the beam during or following its acceleration. The target section 194 defines, on the side proximate to the beam, an opening 196 that is adapted to receive the beam 184. The opening is sealed with a very thin layer of foil comprised of aluminum, and the foil, which functions as the target window 198, also assists in preventing the target substance from escaping. Also, valves 200, 202 in the stainless steel tube secure a selected volume of the target solution in place for bombardment by the beam 184.

The diameter of the stainless steel tube varies depending on the configuration of the micro-accelerator, or more specifically, the micro-cyclotron. Generally, it is less than, or equal to, approximately the increase per orbit in the orbital radius of the beam, which in this embodiment is approximately four (4) millimeters. In this embodiment of the micro-cyclotron, the diameter of the stainless steel tube is approximately four (4) millimeters. Recall that with every orbit, the beam gains a predetermined fixed quantity of energy that is manifested by an incremental fixed increase in the orbital radius of the beam. When a tube having that diameter or less is centered in the path that the beam travels following its final increment of acceleration, an undesirable situation is avoided in which part of the beam, during its previous orbit, bombards the edge of the tube proximate to the center of the orbit, reducing the efficiency of the beam.

As the beam 184 of protons bombards the target substance 180, which in this embodiment has an unusually small volume of approximately one (1) milliliter, the beam 184 interacts with the oxygen-18 atoms in the [$^{18}$O]water molecules. That nuclear interaction produces no-carrier-added fluorine-18 via an $^{18}$O(p,n)$^{18}$F reaction. Such an unusually small volume of the target substance 180 is sufficient because a unit dose of biomarker for PET requires a very limited quantity of the radioisotope, i.e., a mass of radioisotope on the order of nanograms or less. Because the concentration of fluorine-18 obtained from a proton bombardment of [$^{18}$O]water usually is below one (1) ppm, this dilute solution of fluorine-18 needs to be concentrated to approximately 100 ppm to optimize the kinetics of the biomarker synthesis reactions. This occurs upon transfer of the target substance 180 from the micro-accelerator to the radiochemical synthesis subsystem. Before proceeding further, it is also appropriate to note that one skilled in the art will recognize that the internal target subsystem may be modified to enable the production of other radioisotopes (or radiolabeled precursors), including [$^{11}$C]$CO_2$ and [$^{1}$C]$CH_4$, both of which are widely used in research. One skilled in the art will recognize also that certain methods of producing a radioisotope (or radiolabeled precursor) require an internal target subsystem that can manipulate a gaseous target substance. Still other methods require an internal target subsystem that can manipulate a solid target substance.

As indicated previously, the target substance is transferred to the radiochemical synthesis subsystem having at least one microreactor and/or microfluidic chip. Additionally, in order to synthesize the biomarker, at least one reagent other than the radioisotope must be transferred to the radiochemical synthesis subsystem. Reagent, in this context, is defined as a substance used in synthesizing the biomarker because of the chemical or biological activity of the substance. Examples of a reagent include a solvent, a catalyst, an inhibitor, a biomolecule, and a reactive precursor. Synthesis, in this context, includes the production of the biomarker by the union of chemical elements, groups, or simpler compounds, or by the degradation of a complex compound, or both. It, therefore, includes any tagging or labeling reactions involving the radioisotope. Synthesis includes also any processes (e.g., concentration, evaporation, distillation, enrichment, neutralization, and purification) used in producing the biomarker or in processing the target substance for use in synthesizing the biomarker. The latter is especially important in instances when, upon completion of the bombardment of the target substance, (1) the volume of the target substance is too great to be manipulated efficiently within some of the internal structures of the microreaction subsystem (or microfluidic subsystem) and (2) the concentration of the radioisotope in the target substance is lower than is necessary to optimize the synthesis reaction(s) that yield the biomarker. In such instances, the radiochemical synthesis subsystem incorporates the ability to concentrate the radioisotope, which may be performed using integrated separation components, such as ion-exchange resins, semi-permeable membranes, or nanofibers. Such separations via semi-permeable membranes usually are driven by a chemical gradient or electrochemical gradient. Another example of processing the target substance includes solvent exchange.

The radiochemical synthesis subsystem, after receiving the unit dose of the radioisotope and after receiving one or more reagents, synthesizes a unit dose of a biomarker. Overall, the micro-accelerator and the radiochemical synthesis subsystem, together in the same system, enable the generation of a unit dose of the radioisotope in combination with the synthesis of a unit dose of the biomarker. Microreactors and microfluidic chips typically perform their respective functions in less than fifteen (15) minutes, some in less than two (2) minutes. One skilled in the art will recognize that a radiochemical synthesis subsystem having at least one microreactor and/or microfluidic chip is flexible and may be used to synthesize a biomarker other than [$^{18}$F]FDG, including a biomarker that is labeled with a radioisotope other than fluorine-18, such as carbon-11, nitrogen-13, or oxygen-15. One skilled in the art will recognize also that such a subsystem may comprise parallel circuits, enabling simultaneous production of unit doses of a variety of biomarkers. Finally, one skilled in the art will recognize that the biomarker generator system, including the micro-accelerator, may be engineered to produce unit doses of biomarker on a frequent basis.

In still another embodiment of the biomarker generator system, the micro-accelerator is engineered to produce a "precursory unit dose of the radioisotope" for transfer to the radiochemical synthesis subsystem, instead of a unit dose. Unit dose, as stated previously, refers to the quantity of radioactivity, expressed in millicuries (mCi), that is administered for PET to a particular class of patient or subject. For example, a human adult generally requires a unit dose of biomarker in the range of approximately ten (10) mCi to approximately fifteen (15) mCi. Because clinically-important positron-emitting radioisotopes have half-lives that are short, e.g., carbon-11 has a half-life of only approximately twenty (20) minutes, it sometimes is insufficient to produce merely a unit dose of the radioisotope, primarily due to the time required to synthesize the biomarker. Instead, a precursory unit dose of the radioisotope is required, i.e., a dose of radioisotope that, after decaying for a length of time approximately equal to the time required to synthesize the biomarker, yields a quantity of biomarker having a quantity of radioactivity approximately equal to the unit dose appropriate for the particular class of patient or subject undergoing PET. For example, if the radiochemical synthesis subsystem requires twenty (20) minutes to synthesize a unit dose of a biomarker comprising carbon-11 ($t_{1/2}$=20 min), the precursory unit dose of the radioisotope (carbon-11) is approximately equal to 200% of the unit dose of the biomarker, thereby compensating for the radioactive decay. Such a system therefore requires an embodiment of the micro-accelerator that can produce per run at least approximately thirty (30) mCi of carbon-11. Accordingly, such a system requires an embodiment of the radiochemical synthesis subsystem that can receive and process per run at least approximately thirty (30) mCi of carbon-11, which generally is in the form of one of the following two radiolabeled precursors: $[^{11}C]CO_2$ and $[^{11}C]CH_4$.

Another clinically-important positron-emitting radioisotope has a half-life that is even shorter: oxygen-15 has a half-life of only approximately two (2) minutes. Thus, if a microreaction system (or microfluidic system) requires four (4) minutes to synthesize a unit dose of a biomarker comprising oxygen-15, the precursory unit dose of the radioisotope (oxygen-15) is approximately equal to 400% of the unit dose of the biomarker, thereby compensating for the radioactive decay. Such a system therefore requires an embodiment of the micro-accelerator that can produce per run approximately sixty (60) mCi of oxygen-15. Accordingly, such a system requires an embodiment of the radiochemical synthesis subsystem that can receive and process per run approximately sixty (60) mCi of oxygen-15.

One skilled in the art will recognize that, in some instances, the precursory unit dose may need to compensate also for a radiochemical synthesis subsystem that has a percent yield that is significantly less than 100%. One skilled in the art will recognize also that, in some instances, the precursory unit dose may need compensate also for radioactive decay during the time required in administering the biomarker to the patient or subject. Finally, one skilled in the art will recognize that, due to the significant increase in inefficiency that would otherwise result, the synthesis of a biomarker comprising a positron-emitting radioisotope should be completed within approximately the two half-lives immediately following the production of the unit dose (or precursory unit dose) of the positron-emitting radioisotope. The operative half-life is, of course, the half-life of the positron-emitting radioisotope that has been selected to serve as the radioactive tag or label. Accordingly, none of the various embodiments of the micro-accelerator can produce per run more than approximately seventy (70) mCi of radioisotope, and none of the various embodiments of the radiochemical synthesis subsystem can receive and process per run more than approximately seventy (70) mCi of radioisotope.

As indicated in the prior discussion, the low-power the biomarker generator of the present invention may be embodied in many different forms. The low-volume biomarker generator should not be construed as limited to the embodiments set forth herein. Rather, these embodiments are provided to ensure that this disclosure is thorough and complete, and to ensure that it fully conveys the scope of the invention to those skilled in the art.

In sum, the biomarker generator system allows for the nearly on-demand production of approximately one (1) unit dose of biomarker via the schematic illustration depicted in FIG. 4. In an embodiment of the biomarker generator system that requires the production of a concentrated radioisotope-containing solution in order to optimize some or all of the other (downstream) synthesis reactions, the unit dose of biomarker is produced via the embodiment of the method depicted in FIG. 5. Because the half-lives of the radioisotopes (and, hence, the biomarkers) most suitable for safe molecular imaging of a living organism are limited, e.g., the half-life of fluorine-18 is 110 minutes, nearly on-demand production of unit doses of biomarkers presents a significant advancement for both clinical medicine and biomedical research. The reduced cost and reduced infrastructure requirements of the micro-accelerator coupled with the speed and overall efficiency of the radiochemical synthesis subsystem having at least one microreactor and/or microfluidic chip makes in-house biomarker generation a viable option even for small regional hospitals.

From the foregoing description, it will be recognized by those skilled in the art that a low-volume biomarker generator has been provided. In one embodiment, the low-volume biomarker generator includes an improved rf system having a rf power supply rectifying line voltage which is supplied to a step-up transformer. The output of the transformer feeds the rf oscillator to produce an rf signal at the resonance frequency of the oscillator enveloped in the line frequency. In another embodiment, an improved cyclotron eliminating the magnet power supply is provided with an acceleration device including an array of electrodes in the form of dees, and an interposed array of permanent magnets. An ion source is carried within at least one wall of the vacuum chamber for releasing ions into the cyclotron stream. Accordingly, the conventional magnetic coils used in conventional cyclotrons are eliminated, thereby reducing equipment and operating costs, as well as reducing size and increasing operability.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A system for producing a radiochemical, said system comprising:

a cyclotron for generating a beam of charged particles, said beam of charged particles having an energy in the range of approximately 5 to 10 MeV, said cyclotron including a transformer having an input in communication with a rectifier circuit and an output in communication with a radio frequency oscillator, said rectifier circuit adapted to accept a line voltage having a frequency and producing a rectified signal having the line voltage frequency, said transformer receiving said rectified signal and producing an high voltage signal having the line voltage frequency, said radio frequency oscillator receiving said high voltage signal and producing an rf signal having a selected frequency and peak voltage and being enveloped by the line voltage frequency, said rf signal adapted to accelerate positive ions during the positive portions of the rectified signal;

a target adapted to carry a target isotope, said target positioned to allow said beam of charged particles to interact with the target isotope and form a radioisotope; and a radiochemical synthesis system in communication with said target, said radiochemical synthesis system adapted to produce a reaction between the radioisotope and a reagent forming a radiopharmaceutical.

2. The system for producing a radiochemical of claim 1 wherein said transformer is autotransformer.

3. The system for producing a radiochemical of claim 1 wherein said rectifier circuit is a full wave rectifier.

4. The system for producing a radiochemical of claim 1 wherein said cyclotron uses permanent magnets.

5. The system for producing a radiochemical of claim 1 wherein said beam of charged particles is selected from the group consisting of a beam of protons and a beam of deuterons.

6. The system for producing a radiochemical of claim 5 wherein said beam of charged particles is a beam of protons and said beam energy is approximately 10 MeV.

7. The system for producing a radiochemical of claim 5 wherein said beam of charged particles is a beam of deuterons and said beam energy is approximately 5 MeV.

* * * * *